United States Patent [19]

Hashimoto

[11] Patent Number: 4,693,175

[45] Date of Patent: Sep. 15, 1987

[54] CLEAN ROOM SYSTEM

[75] Inventor: Takayoshi Hashimoto, Kanagawa, Japan

[73] Assignee: Takasago Thermal Engineering Co., Ltd., Tokyo, Japan

[21] Appl. No.: 862,227

[22] PCT Filed: Sep. 17, 1985

[86] PCT No.: PCT/JP85/00516

§ 371 Date: Apr. 30, 1986

§ 102(e) Date: Apr. 30, 1986

[87] PCT Pub. No.: WO86/01879

PCT Pub. Date: Mar. 27, 1986

[30] Foreign Application Priority Data

Sep. 18, 1984 [JP] Japan ..... 59-195072

[51] Int. Cl.[4] ..... F24I 3/044

[52] U.S. Cl. ..... 98/31.6; 55/385 A; 98/34.6

[58] Field of Search ..... 55/473, 483, 484, DIG. 29; 98/31.5, 31.6, 34.5, 34.6, 36, 38.1, 38.7, 38.9, 40.1

[56] References Cited

U.S. PATENT DOCUMENTS

| | | | |
|---|---|---|---|
| 3,638,404 | 2/1972 | Moll et al. | 55/484 X |
| 3,880,625 | 4/1975 | Shook | 55/484 X |
| 3,949,809 | 4/1976 | Gilles | 98/34.6 X |
| 4,191,543 | 3/1980 | Peters | 55/DIG. 29 X |
| 4,344,784 | 8/1982 | Deckas et al. | 55/385 A X |

FOREIGN PATENT DOCUMENTS

| | | |
|---|---|---|
| 57-204741 | 12/1982 | Japan . |
| 58-182046 | 10/1983 | Japan . |
| 59-157432 | 9/1984 | Japan . |

*Primary Examiner*—Harold Joyce

*Attorney, Agent, or Firm*—Wenderoth, Lind & Ponack

[57] ABSTRACT

In a system for constructing a ceiling surface exhaling and inhaling system clean room in an existing building without having any exhaust plenum provided under the floor or at the back of walls by supporting fan filter units, air inlet port units and blind panels to a moduled ceiling bars while selecting at will the numbers and positions of these units, a flexible clean room system is provided in which clean zones having necessary degree of cleanliness can be prepared at necessary positions and the changes of the layout of the clean zones, expansion or reduction of the room space can be freely performed.

8 Claims, 49 Drawing Figures

CLEAN ROOM SYSTEM

TECHNICAL FIELD

This invention relates to a multi-purpose flexible clean room system by which a clean room of a desired extent having clean zones of desired degrees of cleanliness can be constructed in an existing building at will with satisfactory work-ability within a short period of time.

The construction of industrial clean rooms and clean tunnels (both inclusive are generally called clean rooms in this specification) is required in industries of semiconductors, fine chemicals, precision machines, etc. However, in the space within the industrial clean room will usually exist working zones where a high degree of cleanliness is required and non-working zones where a high degree of cleanliness is not required, such as those for workers to move, for installation of attached facilities and other marginal spaces. These working and non-working zones differing from each other in the degree of cleanliness of air are formed according to the layout of operation for carrying out productive activities in the clean room by installing properly many air treating equipment for carrying out properly the supply and exhaust of clean air and controlling flows of air. However, vertical laminar flow system clean rooms and horizontal laminar flow system clean rooms produced the most numerously heretofore were sometimes difficult to satisfy versatilely the actual demands of builders.

For example, a production line which has heretofore required no clean room may require a clean room as high quality products are required, or a small-scaled clean room may be required near the existing production line so that the line is obliged to be remodelled for performing only important processes in the clean room. The subject of the highest priority in such a case would be that a clean room to achieve such an object should be constructed within a short period of time without stopping the present operation if possible and without changing substantially the layout of productive equipment and working method. In this construction it is frequently desired that the broadness of the clean room can be freely selected according to the object and the clean zone having a specially high degree of cleanliness can be provided only in a local portion of the space in the clean room. However, even if the prior well-known vertical laminar flow system clean room structure or horizontal laminar flow system clean room structure was intended to cope with such actual demands of builders, it could not satisfy these demands.

While there are various reasons for disabling said structure from coping with said demands, the fundamental one is that a plurality of members and equipment for forming the controlled flows of clean air are required to be installed on the floor of an existing building according to the design standards of the side of the clean room to be formed. The reason is that, for example, to control the air flow and separate the working zones from the non-working zones having different degrees of cleanliness, partition walls and posts are provided, wall members for surrounding and installing air treating equipment are required to be installed in a predetermined relation to each other, and a part or all of the instruments of the air treating equipment including fans, air inlet ports, air outlet ports, ducts, HEPA filters, heat exchangers, etc., are required structurally to be installed in a predetermined relation to each other between the ceiling and the floor. Further, an exhaust plenum and a supply air plenum are required to be newly prepared respectively beneath the floor or on the back of wall and on the back of ceiling or wall. Particularly in the vertical laminar flow system the ceiling surface and the floor surface provide respectively an air outlet port and an air inlet port and in the horizontal laminar system a certain wall surface provides an air outlet port and the wall surface opposed to said wall surface provides an air inlet port so that the ceiling surface and the floor surface or the wall surfaces themselves had to be constituted in a certain relation to each other. This also makes the effective space of the clean room extremely narrower and the change, expansion and contraction in the layout further difficult. Particularly once the air treating equipment has been installed, the expansion and contraction of the space of the clean room and the changes in the clean zones within the clean room could not be easily carried out.

Accordingly it is not too much to say that the prior clean room could not be constructed without once removing the production line and production machinery from the clean room space to be formed in a factory or the like already in the productive activity. Though the applicant extensively executed as possible as he could a search or the prior art concerning the clean room systems capable of forming a high degree of clean room without removing productive machinery from the site and the ceiling outlet and inlet system clean rooms without the exhaust plenum and supply air plenum or the like, he could not find any well-known technical literatures related to the clean room system according to the present invention which will be described hereinafter.

An object of the present invention is to provide a flexible clean room which can cope with any various demands of builders which such prior clean rooms could not cope with. Further, it is to constitute easily, properly and freely a desired scale clean room in an existing building without removing operating productive machinery, if any, and to execute the construction of said flexible clean room witin a short period of time at a low cost. Also, the present invention, while achieving the above objects, aims to construct at will a clean room of a desired extent having clean zones of different degrees of cleanliness ranging from Class 100 to Class 100,000 according to the U.S. Federal Standard 209b even without any provision of partition walls. The above-mentioned degree of cleanliness of Class 100 specified in the U.S. Federal Standard 209b means a particle count not to exceed 100 particles per one cubic feet of a size 0.5 μm or larger and the degree of cleanliness of Class 100,000 means a particle count not to exceed 100,000 particles per one cubic feet of a size 0.5 μm or larger.

DISCLOSURE OF THE INVENTION

The present invention provides a clean room system as one to achieve the above mentioned objects, in which a ceiling is formed in an existing building leaving the ceiling space to form an enclosed space defined by said ceiling, suitable floor surface and walls and insulated from the surrounding atmosphere, and an air treating equipment for supplying clean air into said enclosed space while withdrawing a volume of air therefrom substantially corresponding to the volume of the clean air supplied thereinto is installed to thereby constitute the clean room having clean zones of different degrees of cleanliness ranging from Class 100 to Class 100,000 according to the U.S. Federal Standard 209b, said clean room system characterized in that:

said ceiling is formed by suspending horizontally ceiling bars provided with a plurality of predetermined rectangular openings having the dimension substantially equal to each other while leaving the ceiling space, and by supporting removably on the openings of the ceiling bars prefabricated ceiling elements each having a base area adapted to close each of said openings so as to close each opening with each ceiling element, said ceiling element being selected from the group consisting of a blind panel, a return air inlet port unit and a fan filter unit having a built-in fan and a HEPA filter;

an air conditioner is installed outside said enclosed space;

supply air duct means for delivering air conditioned by said air conditioner to each fan filter unit attached to the opening and return air duct means having a connecting duct capable of recirculating air taken into at least one of said air inlet port units attached to the opening to each fan filter unit without passing the air through the air conditioner are installed outside the enclosed space to be formed, and when said ceiling elements are attached to the openings, the locations and the numbers of the respective ceiling elements are selected according to the locations and the degrees of cleanliness of the desired clean zones to form the clean zones having different degrees of cleanliness in the enclosed space by ceiling surface exhaling and inhaling air flows.

The distinctive feature of the invention resides in the method for constructing the clean room and this will be described hereinafter in detail. The clean room according to the invention can be said to be a ceiling surface exhaling turbulent flow system clean room from a viewpoint of the classifying concept of the clean rooms. From a viewpoint of that the air inlet ports for sucking forcibly air in the room space to the outside are provided on the ceiling surface according to the invention and the wall and floor surfaces may not have any air inlet port, the clean room can be said to be quite eccentric in the prior art ceiling surface exhaling turbulent flow system clean rooms. This is because the formation of a clean zone having a high degree of cleanliness in the room space of the clean room having the clean air outlet and inlet ports in the ceiling is quite the retrogression against the trend of recent high quality clean room forming technology. The clean room according to the invention can be suitably applied to fields requiring the clean zones having a high degree of cleanliness, for example, IC production, biochemistry, food production, fine chemical production, medical treatment, assemblage of precision machine, etc. However, there is a general common sense that the turbulent flow system clean room will be unable to provide a clean room of higher degree of cleanliness along with the progress of technology in these fields (thus, the vertical laminar flow system clean room having planer inlet ports in the floor has been widely developed). In addition, when the ceiling surface inhaling system is employed in the turbulent flow system clean room for example, a person skilled in the art would normally expect that take-up air flow will be produced in the chamber to diffuse dust and short circuit from the ceiling surface outlet port to the ceiling surface inlet port will be formed not to provide the clean zones having a high degree of cleanliness. Thus, the clean room according to the invention to provide the clean zones having a high degree of cleanliness by the turbulent flow system clean room of ceiling surface exhaling and inhaling system is quite new type of clean room which shatters such conventional concept. This provision of the new type of the clean room, as will be later proved by test examples, is made possible by the effective utilization of phenomenon that the inlet port for forcibly withdrawing air supplied to the enclosed space therefrom produces inlet air current only in a position very close to this inlet port even if this inlet port is installed in the ceiling without substantially giving any effect on the tendency of air current in the space.

And the clean room formed according to the invention structurally differs from prior ones in that it does not substantially have the exhaust plenum and supply air plenum. Prior industrial clean rooms, with few exceptions, can be said to be of an air circulation structure which is provided below the floor or on the back of wall with the exhaust plenum from which a blower sucks air to discharge it to the supply air plenum on the back of wall or ceiling. According to the invention, such plenums as constituted of construction materials are not provided on the backs of inlet port surface and HEPA filter surface, and the inlet port and outlet port in the ceiling are constituted as terminal units which can be connected to a duct in any selective installation positions.

Now, when such a ceiling surface outlet-inlet clean room is to be constructed, the invention aims to construct the clean room having a space which builders desire only with a substantial work of ceiling surface such that a clean zone having a necessary degree of cleanliness is formed in a necessary position even if production machines exist in the space and remains as they are. Thus, according to the invention, a spacial moduled ceiling structure is constructed in an existing building. And by this ceiling structure and walls is formed the enclosed space insulated from the ambient atmosphere, and necessary instruments and ducts of air treating equipment to form the clean room are adapted not to put in the enclosed space. Then, the invention of course satisfies the requirement for the clean room in which clean air is supllied to the enclosed space through the HEPA filters and indoor air is discharged (sucked out) from the enclosed space for circulation of air while pressure in the enclosed space is maintained slightly higher than that in the ambient atmosphere.

The assembly of the ceiling bars according to the present invention is constructed by the use of special moduled ceiling frames and the attachment of moduled fan filter units, air inlet port units and blind panels to the ceiling frames. Ducts for forming air supply pipe paths are piped by utilizing the ceiling space, and loads of the so formed ceiling structure and equipment installed in the ceiling space are all supported by suspension from beams or the like of the building body. The above-mentioned moduled ceiling frames mean ones formed with a plurality of small openings (gridiron openings) having a predetermined rectangular configuration and substantially equal dimension. The moduled fan filter unit, air inlet port unit and blind panel mean ones moduled to have the size for closing the small opening areas of the rectangular openings. The small rectangular openings are formed by arranging bars orthogonal to each other at equal intervals. As an embodiment in this case, the ceiling frame having a plurality of the small openings is made one module of ceiling frames which can form a necessary ceiling area by connecting necessary numbers of the modules to each other. As another embodiment, bars having a predetermined length in a certain direction may be connected to other bars orthogonal to said bars to form a necessary ceiling area of a necessary length.

The fan filter unit comprises a HEPA filter and a fan built in a casing adapted to close the opening area of the small rectangular openings. The lower surface of the casing is opened and this opening of the casing is closed by the HEPA filter. The upper surface of the casing has a duct connecting tube, and the fan is attached in a space within the casing between the upper surface of the casing and the HEPA filter. The height of the casing can be as low as only 30–40 cm. The inlet port unit is a box having the lower surface opened and adapted to close the opening area of the small rectangular openings, and a punching board is preferably suspended across this opening of the lower surface of the box. A duct connecting tube is provided on the upper surface of the box. The height of the box can be as low as only 10–30 cm.

When clean air is blown into the enclosed space, the air is purified by the HEPA filter of each fan filter unit and the air blowing power is shared by the fan of each fan filter unit. Since the enclosed space is maintained at pressure somewhat higher than the ambient pressure, air discharged from the enclosed space (air forcibly taken out of the enclosed space) except for air leaking inevitably naturally from the enclosed space to the ambient atmosphere is allotted to the air inlet port units in the ceiling. However, when a zone in which dust is particularly produced exists in the enclosed space, air in that zone may be discharged to the outside of the system through a separate route by a fan.

According to the invention, the fan filter units and the air inlet port units can be grasped as terminal units of air treating equipment which can attach any numbers of them to any positions of the ceiling. To each fan filter unit can be supplied circulating air directly (i.e., not through an air conditioner) from any of the air inlet port units. That is, each terminal of the blow-off side is connected to at least one of the terminals of the inlet side through a duct (this duct is called a connecting duct in this specification). Thus, the connecting ducts will be required by at least the number of terminals at the outlet side. In this respect, the clean room according to the invention differs much from most of conventional clean rooms provided with exhaust and supply air plenums to treat circulating air integrally. According to the invention, the power of blown-off air is allotted to the fans of the respective fan filter units and the suction of the air inlet port unit can be carried out by the power of these fans so that the power of the supply air fan in the air conditioner may not substantially participate in the blow-off of air to the clean room and the suction of air from the clean room. The supply air fan in the air conditioner will do which can supply air conditioned by the air conditioner to the fan filter units. The duct for supplying the conditioned air to each fan filter unit is called a main supply air duct in this specification.

Hereinafter will be particularly described the contents of this invention with reference to the drawings.

BRIEF DESCRIPTION OF THE DRAWINGS

FIG. 13(*b*) is a partial sectional view of the bar showing the relationship between the bar and hanging bolt;

FIG. 17(*b*) is an enlarged view of a part of the ceiling element of FIG. 17(*a*);

DETAILED DESCRIPTION OF THE INVENTION

Figure 1:
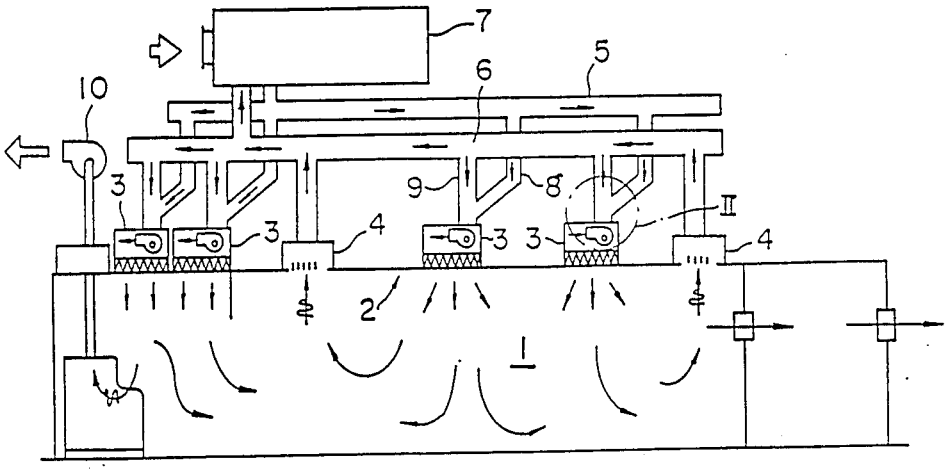
FIG. 1 is a schematic longitudinal sectional view of the whole system for explaining motions of air in a clean room according to an embodiment of the present invention.

FIG. 1 shows illustratively the principle of motions of air and temperature-humidity adjustment mannually treated for explaining features in the type of a clean room formed according to the invention. As shown in FIG. 1, the clean room according to the invention belongs to a turburent flow system clean room of ceiling outlet and ceiling inlet type. As shown in FIG. 1, according to the present invention, when a new clean room space 1 is formed in a building, the whole instruments for treating air are substantially installed on a ceiling 2 itself formed newly and a space thereabove, and the clean room having clean zones of the desired degree of cleanliness and the desired area is formed newly at the desired position in the existing building substantially only by the work of ceiling except for the work of mounting wall materials. This means that it is substantially unnecessary to prepare an exhaust plenum under the floor and on the back of wall and remove and transfer various machines on the floor to build the clean room.

Figure 2:
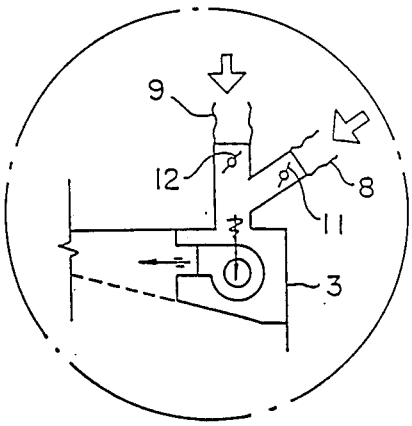
FIG. 2 is an enlarged view showing a part of the system of FIG. 1.

The ceiling of the clean room space 1 formed according to the invention consists of the new ceiling 2 horizontally formed leaving the ceiling space in the interior of the existing building. At any positions of the ceiling 2 are installed prefabricated fan filter units 3 each having a built-in HEPA filter and fan and a return air inlet port units 4 (these units will be later detailed), and in the back space of the ceiling 2 are installed a main supply air duct 5 and a main return air duct 6. An air conditioner 7 is also installed above the ceiling 2 in FIG. 1. The air conditioner 7 is selectively used which is of a type suited for the load on the room space 1. In the system according to the invention as shown in FIG. 1, the exhaling of clean air into the room space 1 and the inhaling of air from the room space 1 are carried out in principle on the ceiling surface. Referring to the motions of air, first, a part of the return air from the main return duct 6 and the open air are introduced into the air conditioner 7 by driving a fan equipped in the air conditioner 7 and the air conditioned therein is caused to flow to respective fan filter units 3 through the main supply air duct 5. In the embodiment shown in FIG. 1, the main supply air duct 5 is connected to each fan filter unit 3 through a branched supply duct 8 to which a branched return duct 9 is connected such as to introduce a part of the return air in the main return duct 6. Thus, to each fan filter unit 3 are introduced the air conditioned by the air conditioner 7 and a part of the return air sucked in the return air inlet port units 4. The air is blown into the room space 1 by driving the fan built in the fan filter unit 3 after being purified through a layer of the HEPA filter stretched horizontally in the fan filter unit 3. On the other hand, the air in the room space 1 is sucked through the return air inlet port units 4 provided on the surface of the ceiling 2, and caused to flow through the main return duct 6, partly to the air conditioner 7, while the remaining to the fan filter units 3 directly. An exhaust air from the room space 1 is exhausted to the outside of the system by an exhaust fan 10, which is provided outside the system. An amount of the air corresponding to the exhaust air becomes an amount of taken-in open air to the air conditioner 7. Adjustment of the temperature and humidity of the air blown into the room 1 are carried out by adjusting the proportions of the air supplied from the air conditiner 7 and the return air from the main return duct 6. As shown in FIG. 2, the adjustment is carried out by controlling dampers 11 and 12 respectively mounted on the branched supply duct 8 for supplying the air to each fan filter unit 3 and the branched return duct 9. These dampers 11 and 12 may be of manual type. When a high accuracy temperature adjustment is required, it is preferable to use electromagnetic dampers which can be automatically controlled by means of a thermostatt. Thus, the temperature and humidity of the air blown from each fan filter unit 3 can be individually adjusted.

The most characteristic points in this case are that when the air treating equipment is installed in the ceiling, the ceiling is formed by horizontally suspending ceiling bars formed with a plurality of predetermined rectangular openings having the same dimenssion and by removably supporting on the openings of the bars ceiling elements, while selecting the numbers and the mounting positions of the ceiling elements according to the position of the desired clean zones and the degree of cleanliness, each ceiling element having a base area adapted to close each of the openings so as to close each opening by each ceiling element. The ceiling element is selected from the group consisting of a blind panel, a return air inlet port unit and a fan filter unit having a built-in fan and HEPA filter. The enclosed space having a necessary capacity is formed of the new ceiling and wall members on the floor, and the air treating equipment required for operation is disposed outside the enclosed space (substantially in the ceiling space).

Hereinafter will be particularly described some preferred embodiments of the clean room system with reference to the drawings.

In a preferred embodiment of the clean room system according to the invention the ceiling is constructed of prefabricated square modules of ceiling frames. For example, A openings (for example, 3–5 openings) are provided in one side, and B openings (for example 3–5 openings) are provided in the other side orthogonal to said one. Thus, the necessary numbers of the square modules having as a whole A×B rectangular openings each having the same dimension are used to constitute the ceiling having a desired area. This embodiment is illustrated in FIGS. 3 to 9. In another preferred embodiment, bars which can increase or decrease the number of openings in any directions are used and assembled to constitute the ceiling area having the necessary area. This embodiment is illustrated in FIGS. 10 to 25. In any case, the load on the ceiling (total load of bars and ceiling elements) and the load of the air conditioner and ducts disposed above the ceiling can be suspended from beams or the like provided in the existing building by means of hanging metallic members. If the strength of beams or the like in the building would be insufficient, poles should be erected from the floor to make up for the insufficient strength. By employing such hanging ceiling system can be freely formed various clean zones suited for the production line.

Figure 3:
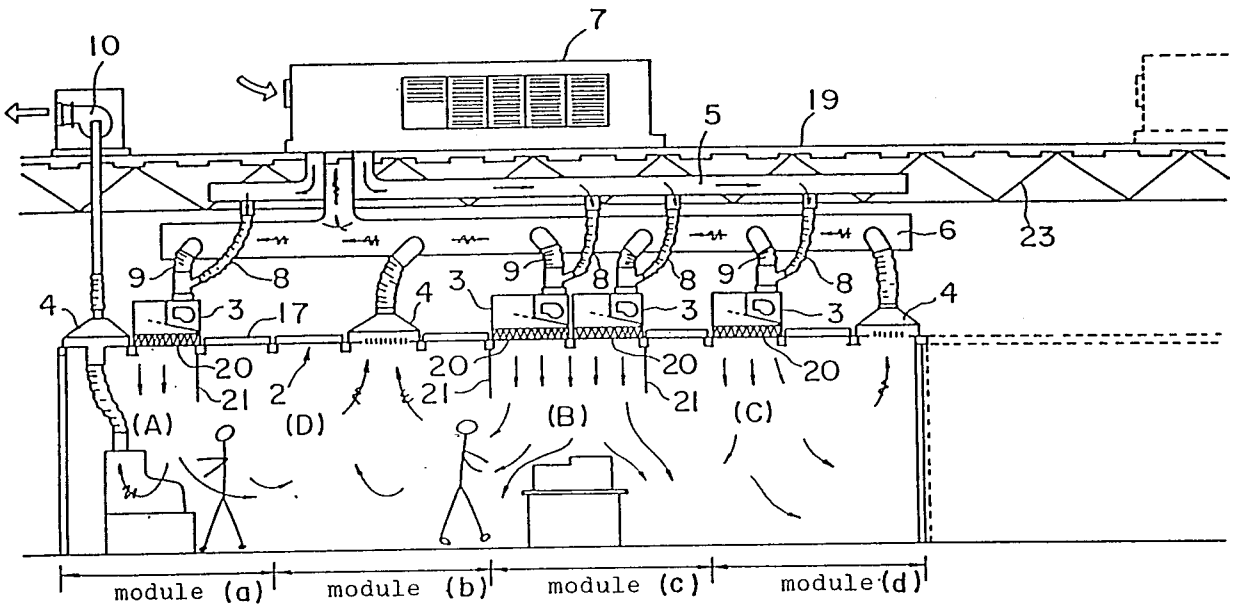
FIG. 3 is a schematic longitudinal sectional view showing a layout of the clean room equipment of which a single air conditioner may take charge in the clean room system according to the present invention.
Figure 4:
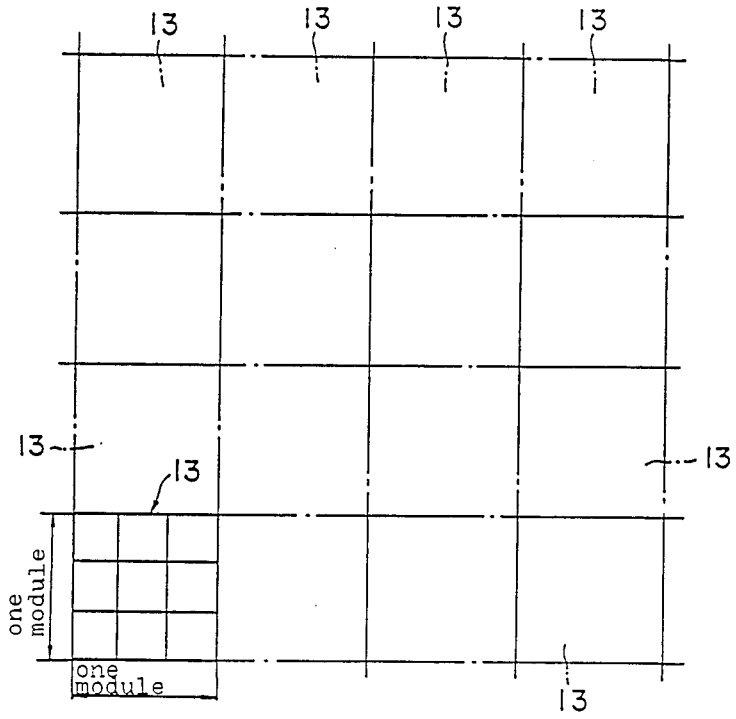
FIG. 4 is a schematic plan view showing an assembly of the ceiling bars of the clean room system shown in FIG. 3, which consists of 16 modules of ceiling frames.
Figure 6:
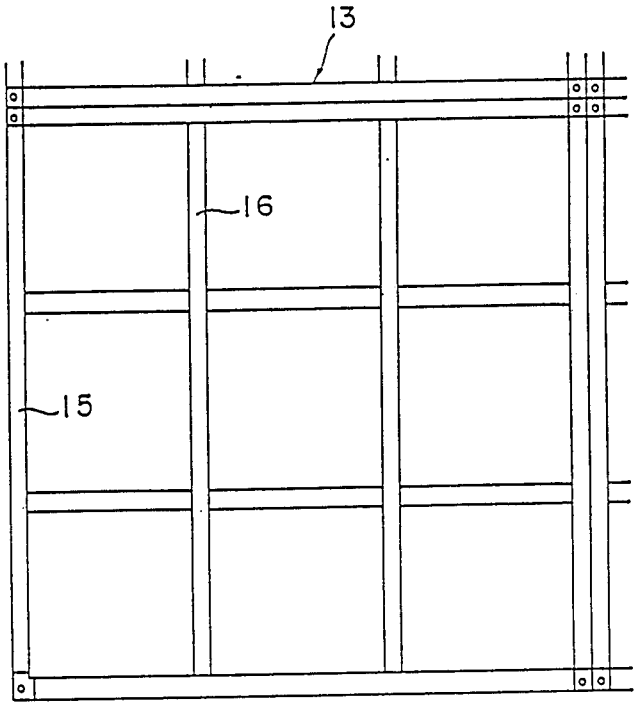
FIG. 6 is an enlarged schematic plan view showing the module shown in FIG. 4.

FIG. 3 shows somewhat illustratively a longitudinal section of the clean room in operation formed according to the present invention. In FIG. 3, the ceiling frame 2 of the clean room is formed of a plurality of square modules 13 having a planer extent as shown in FIG. 4. In this embodiment of FIG. 4, 4×4=16 pieces of square modules of ceiling frames 13 are adjacent each other to form a square ceiling area. As shown in FIG. 6, in each module 13, a plurality of openings like checkers are formed of bars 15 and 16 such as light weight angle steel spaced by equal intervals from and orthogonal to each other. FIG. 6 shows one module 13 formed with 9 square openings each having an equal area. Thus, when the 16 modules 13 in the embodiment shown in FIG. 6 are used and arranged adjacent each other, 13×16=208 openings are formed by the bars 15 and 16 as shown in FIG. 4. Thus, for the ceiling of the clean room in FIG. 3 are used and provided continuously four modules 13 in the left and right directions of the drawing and four ceiling bar members in the front and back direction of the drawing (only one longitudinal section thereof is shown in the drawing). An air conditioner is installed which takes charge of air conditioning load in the planer portion formed of adjacent 4×4=16 modules 13. On the square openings of each module 13 are mounted ceiling elements selected from the fan filter units 3, retrun air inlet port units 4 and blind panels 17 each adapted to close the area of each opening.

Figure 5:
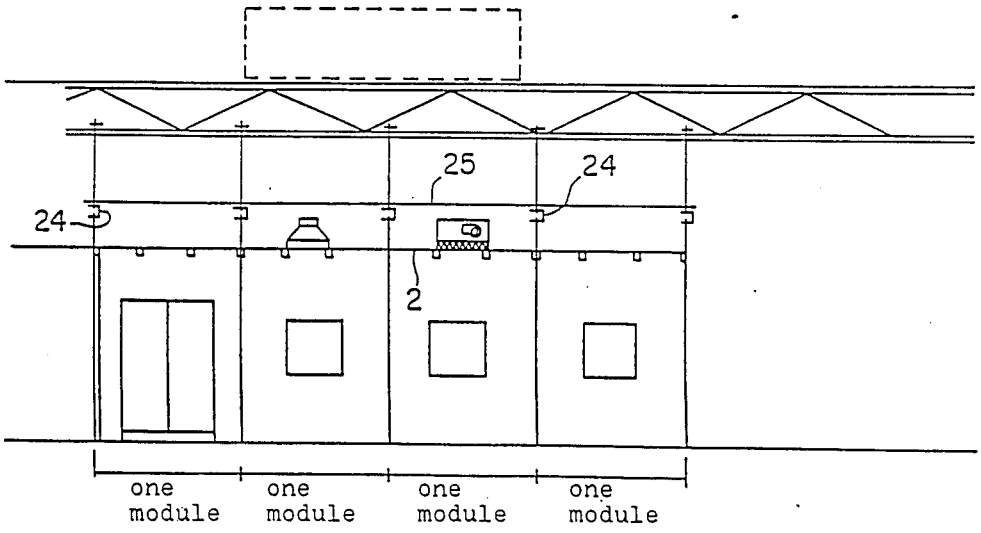
FIG. 5 is a schematic side view showing an example of wall portion of the clean room system shown in FIG. 3.
Figure 7:
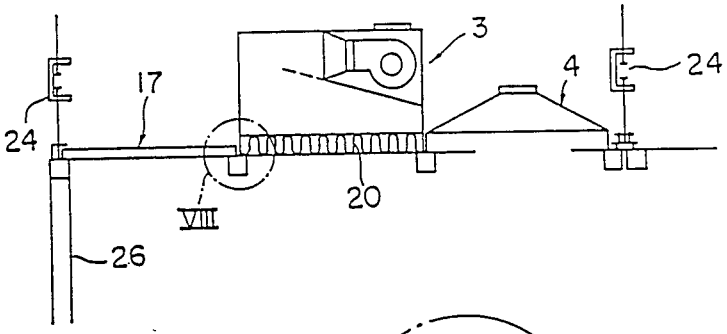
FIG. 7 is a schematic side view showing the module of FIG. 6, on which a fan filter unit, a return air inlet port unit and a blind panel are attached.
Figure 8:
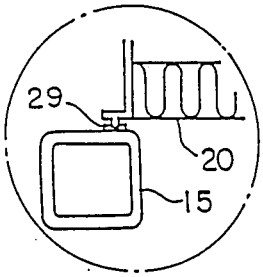
FIG. 8 is an enlarged view showing a part of the module shown in FIG. 7.

Each module 13 is suspended from the ceiling by utilizing existing beams 23 (shown in FIG. 3) in the existing building. For example, hanging metallic members 24 shown in FIGS. 5 and 7 are suspended from the beams 23 and connected to the corners of the respective modules 13 to hang each module 13 at the four corners. The hanging metallic members 24 used can be freely adjusted with respect to their hanging length. If a suspended stage 25 (shown in FIG. 5) on which workers can freely walk is formed between the ceiling 2 and the beams 23 in the hanging, it can be conveniently utilized also in maintenance. Also, in the deficiency of the strength of beams can be used a removable posts 26 as shown in FIG. 7.

When the ceiling bars of the modules of ceiling frames are thus stretched horizontally leaving the ceiling space, the ceiling elements selected from the group consisting of prefabricated fan filter units 3, return air inlet port units 4 and blind panels 17 are mounted on the respective openings of the ceiling bar such that each element may close each opening while the numbers and locations of attachment are freely selected. While the ceiling structure of the room space 1 is thus constituted, the combination of the respective numbers and locations of the ceiling elements can be freely selected according to the desired degree of cleanliness and position to be cleaned. For example, referring to the section shown in FIG. 3, one return air inlet port unit 4 (provided this is used for exhaust and the exhaust duct is connected to the exhaust fan 10 outside the system) and one fan filter unit 3 are provided in the module (a) shown in the left end of the same drawing and other openings are covered with the blind panels 17. Similarly, one return air inlet port unit 4 is in the module (b) and other openings are covered with the blind panels 17. The module (c) is provided with two fan filter units 3 and other openings are covered with the blind panels 17 and the module (d) is provided with one fan filter unit 3 and one return air inlet port unit 4 and other openings are covered with the blind panels 17.

To facilitate the alteration of the mounting and position of each ceiling element on such openings, each ceiling element is removably attached to the opening. This removable attachment is achieved only by putting each ceiling element on the opening. For example, while FIG. 7 shows sections of the blind panel 17, fan filter unit 3 and return air inlet port unit 4 mounted on one module 13 shown in FIG. 6, a packing, for example soft neoprene gasket 29, is placed on the bars 15 and 16 as is illustrated only with respect to the fan filter unit 3 in FIG. 8 and the attachment is achieved by mounting the lower edges of the blind panel 17 or the units 3 or 4 on this gasket 29. Only by this mounting will be pressed down the gasket 29 with the weight of each member so that a satisfactory seal can be provided between the room space 1 and the ceiling space.

For the walls to insulate the room space 1 from the ambient atmosphere may be utilized a portion of the wall of the existing building. However, as shown in FIG. 5, unit wall materials having the width corresponding to the size of the module 13 are preferably prefabricated and installed to form the necessary room space area.

The air conditioner 7 in the embodiment of FIG. 3 takes charge of the air conditioning load on the clean room space 1 formed under an area (for example, about $100m^2$) in which the 16 adjacent modules 13 (the dimension of each module is 2.5m×2.5m for example) are provided. The air conditioner 7 is provided on a roof 19, and the main supply air duct 5 and the main return air duct 6 are provided in the ceiling. Also, as shown in FIGS. 1 and 2, the branched supply duct 8 and the branched return duct 9 are connected to each fan filter unit 3 so that the air flow, temperature and humidity are adjusted as described with reference to FIG. 1.

Though the return air inlet port units 4 are provided on the ceiling, by this constitution is blown out the air purified by the HEPA filters 20 of the fan filter units 3 to the working zones (A) and (B) shown in FIG. 3 for example and further to the non-working zone (C) so that the clean zones having different degrees of cleanliness, for example, a degree of cleanliness of Class 1,000 as specified in the U.S. Federal Standard 209b will be obtained for the working zone (A) and that of Class 100 as specified in the same standard will be obtained for the working zone (B). A degree of cleanliness of Class 10,000 will be obtained for the non-working zone (C). The degree of cleanliness can be further improved by providing eye lids 21 suspended from the fan filter units 3 in the section forming the working zones (A) and (B).

Preferably the adjacent fan filter units 3 are provided in the working zone requiring a high degree of cleanliness. While this embodiment is shown in the module (c) of FIG. 3, a clean zone similar to a clean tunnel can be formed by arranging in a row the adjacent fan filter units 3 even though the particular wall is not present. While the return air inlet port unit 4 is preferably attached to the ceiling bar in the area which is the non-working zone, the number of said units 4 does not necessarily coincide with that of the fan filter units 3. If enlargement of the area of the clean room is desired, it may readily be done by additionally constructing similar clean room or rooms according to the invention in the contiguity to the existing clean room as shown in FIG. 3 by dotted lines. Also contraction of the area of the clean room can be easily done.

Figure 9:
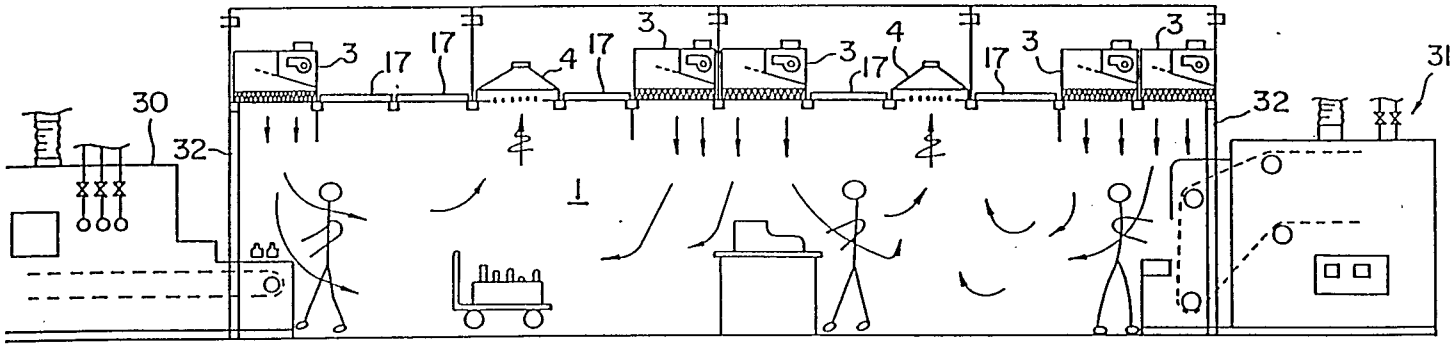
FIG. 9 is a schematic longitudinal sectional view showing an example of constructing a clean room formed with clean zones according to the invention when the necessary clean zones are intended to be formed in a building wherein voluminous productive machines exist.

FIG. 9 shows an embodiment of the relative arrangement of the clean room according to the invention and production facilities requiring the clean room. In a factory are installed productive machines 30 and 31, for example a large apparatus 30 for bottling liquefied chemicals, a large apparatus 31 for taking up foil and others. When the clean zones are required to be formed only in stations of processes for filling chemicals into the bottles and taking up foil even if the whole large apparatus are not included in the clean room, the clean zones having the desired degrees of cleanliness can be freely formed at any desired locations in the building according to the invention. Therefore, such requisition can be satisfied by mounting the walls 32 so as to include only what require the clean zones in the room space 1 as shown in FIG. 9 and installing the fan filter units 3 near the clean zones.

Figure 10:
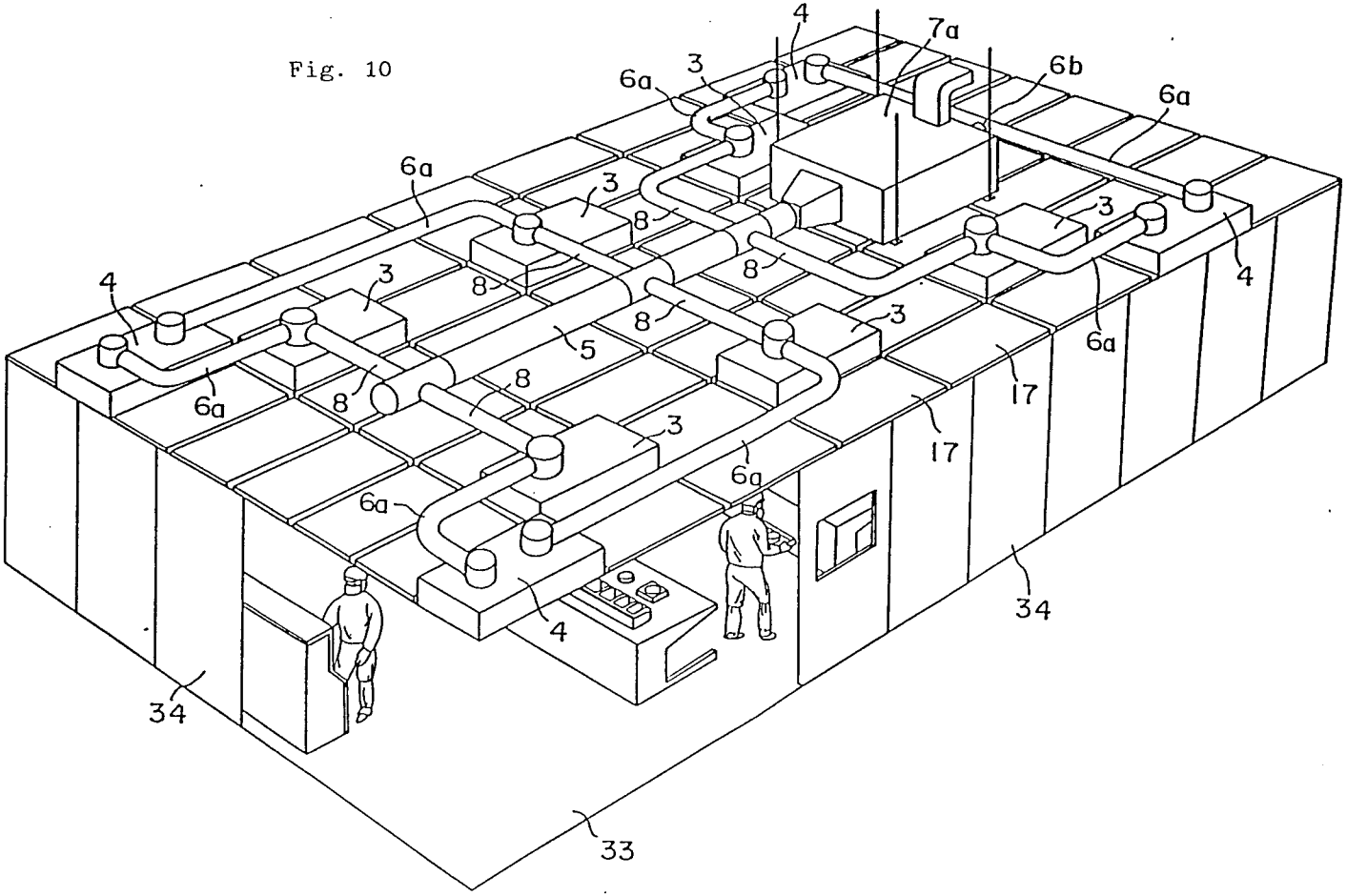
FIG. 10 is a perspective view showing a clean room system constructed according to another embodiment of the invention.

FIG. 10 shows an example of the clean room system as a whole according to another embodiment of the invention. In this example differing from ones previously described, instead of the system using the modules prefabricated with a plurality of openings, a new ceiling is formed by forming only the necessary numbers of openings with rated dimension with a special framing construction called a T-bar system in this specification hereinafter and attaching to these openings removably the prefabricated ceiling elements selected from the group consisting of the fan filter unit 3, air inlet port unit 4 and blind panel 17 each having the rated dimension. In the example shown, the six fan filter units 3, four air inlet port units 4 and the blind panel 17 are attached to the other openings. For the air conditioner is used a separate type air conditioner comprising cooperating outdoor half and indoor half and only indoor half 7*a* is seen in the drawing. A wall panel 34 is provided on the floor 33 along the outer edge of the new ceiling so that the enclosed clean room space is formed under the condition which is insulated from the ambient atmosphere in the building. As shown in the drawing, on the floor 33 and the wall panel 34 is absent the air inlet port for forcibly introducing the air from the inside to the outside of the enclosed space. The exhaling of the clean air and the inhaling of the indoor air are all carried out from the new ceiling to display the function of the clean room. In FIG. 10, to introduce the air conditioned by the indoor half 7*a* into the respective fan filter units 3, the main supply air duct 5 is provided on the approximately central portion of the new ceiling and the branched supply air duct 8 is provided from the main supply air duct 5 to the respective fan filter units 3. The return air ducts 6*a* for supplying the air sucked by the air inlet port units 4 to the respective fan filter units 3 are installed and an air circulating return duct 6*b* for circulating the air to the indoor half 7*a* is provided in one of these return air ducts 6*a*. The return air ducts 6*a* are the connecting ducts which can introduce the indoor air taken in at least one of the air inlet port units to the respective fan filter units without passing the air through the air conditioner.

FIGS. 11 to 18 are explanatory illustrations of the ceiling bar constituting system called the T-bar system using special bars.

Figure 11:
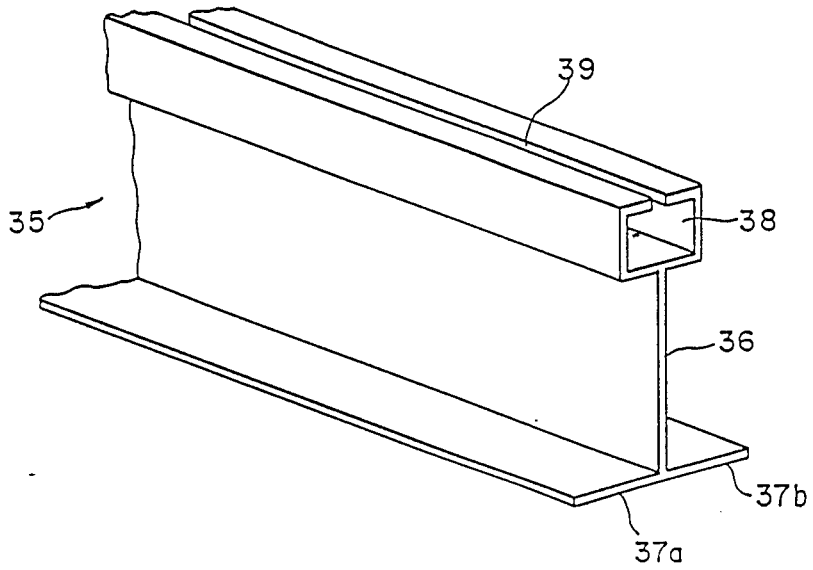
FIG. 11 is a partial perspective view of a preferred bar for constituting the ceiling bar according to the invention.

FIG. 11 shows the representative form of the bar 35 used. As shown in the drawing, the bar 35 consists of a vertical shell plate 36, flanges 37*a* and 37*b* extending horizontally from the lower edge of the shell plate to both sides and a hollow box 38 connected to the upper edge of the vertical shell plate 36. And the box 38 is formed on the top with a slit 39. The bar 35 is symmetrical left and right about the vertical line passing through the center of the shell plate 35 as viewed in the section orthogonal to the longitudinal direction. The projecting length of the flanges 37*a* and 37*b* projecting left and right from the vertical line is longer than that of the box 38 projecting from the vertical line. Preferably, the bar 35 is formed of metal of integrated shell plate 36, flanges 37*a* and 37*b* and box 38. For example, the integrated article is an aluminum extruded shape. As will be described later, the slit 39 formed in the upper surface of the hollow box 38 is used for mounting the lower end of a hanging bolt when the ceiling bar formed by the combination of these bars 35 is suspended from the beams or the like of the building.

Figure 12:
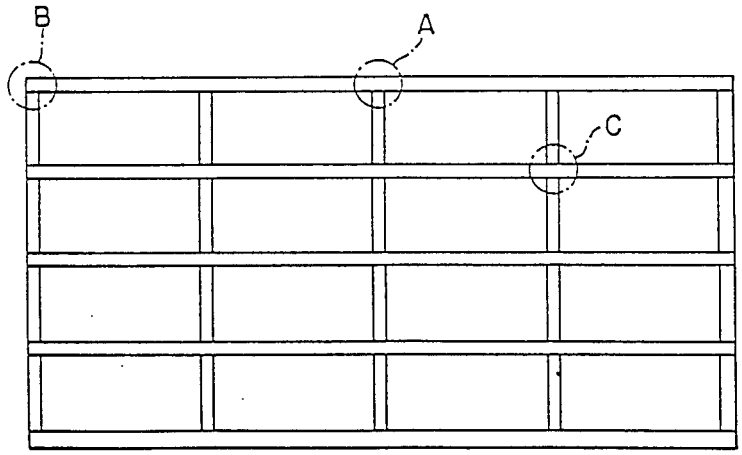
FIG. 12 is a plan view showing a part of the ceiling bars constituted from the combination of bars in FIG. 11.
Figure 13A:
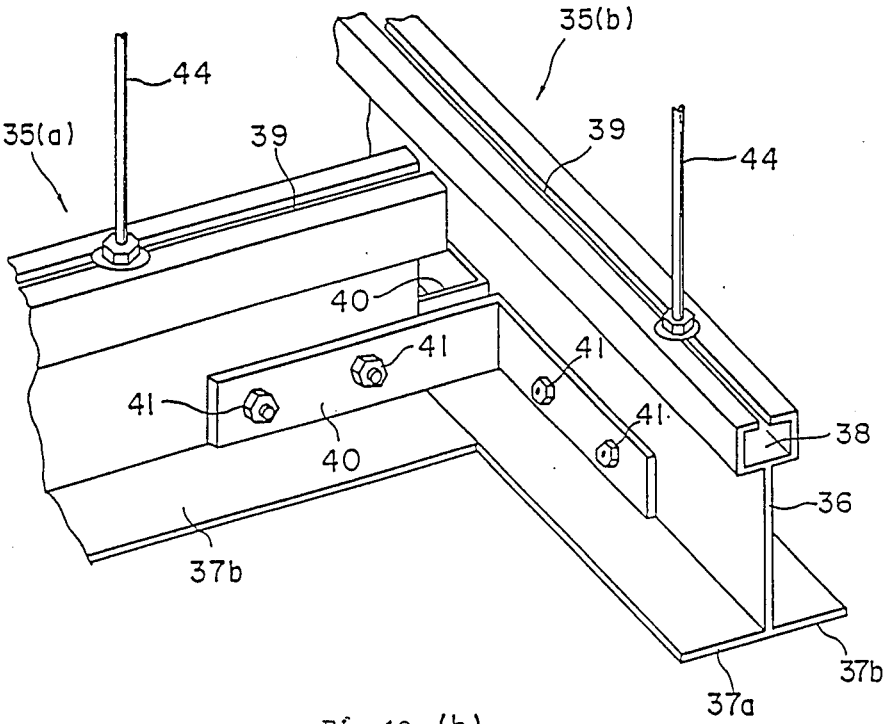
FIG. 13(*a*) is a perspective view showing an example of connection of bars themselves in FIG. 11.
Figure 13:
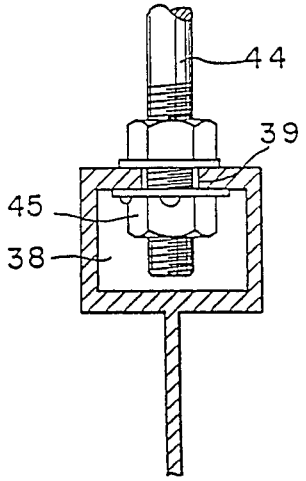
Figure 14:
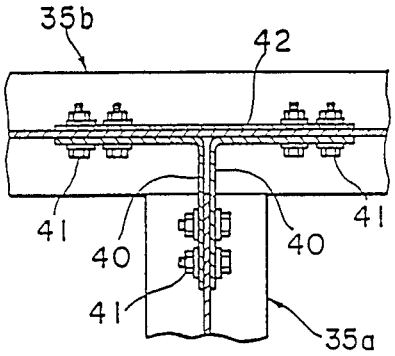
FIGS. 14, 15 and 16 are sectional plan views showing details of connecting conditions on the positions shown in A, B and C of FIG. 12.
Figure 15:
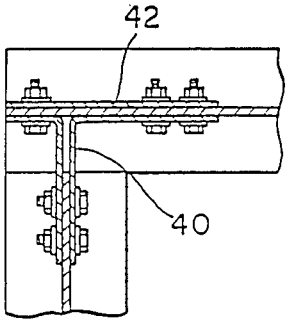
Figure 16:
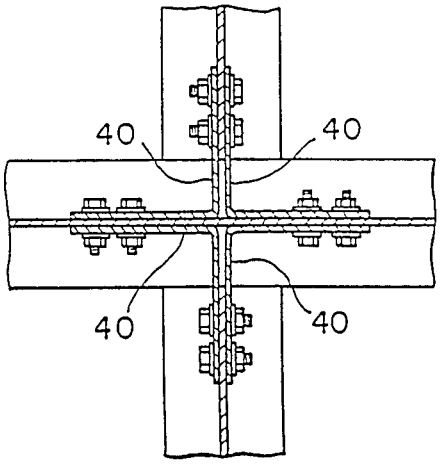

FIG. 12 shows an example of the ceiling frame in which these bars 35 are combined on the same plane orthogonally to each other in a predetermined intervals to form checker-like openings each having the same dimension. The dimension of each opening may be 600 mm 1200 mm when it is measured between the centers of the bars 35 for example. Referring to the assembly of the bars 35, the section A in FIG. 12 for example is made as shown in FIG. 13(*a*). That is, an end of one bar 35(*a*) (an end having the end face perpendicular to the longitudinal direction) is butted against the middle portion of the other bar 35(*b*) in the same plane. By this butting, the ends of flanges 37*a* and 37*b* of one bar 35(*a*) contact the outer edge of one flange 37*a* of the other bar 35(*b*). The contact portion will be prevented from leakage of the air by subsequently applying a tape or the like thereon. To fix this contacting condition of both bars, an angle members 40 are used for fixing to the shell plates 36 of both bars by connecting members 41 consisting of bolts and nuts. FIG. 14 shows this condition as viewed in the sectional plan view which clarifies the angle members 40 provided at both corners. Also, in addition to these angle members 40 is used a reinforcing member 42 at the bar 35(*b*) side in fastening the connecting members 41. Similar connection relationship is shown in FIG. 15 with respect to the section B of FIG. 12 and in FIG. 16 with respect to the section C of FIG. 12.

By the butt connection of such bars 35 are formed the checker-like openings of the same configuration having a rectangular area surrounded by the outer edges of the flanges 37*a* and 37*b* of each bar 35. In the case of this example, the ceiling bar having the openings as a module is constituted by providing the module of the opening having this opening area (having the rated dimension). The whole ceiling bars are suspended from the beams or the like of the building, those being carried out by the use of hanging bolts 44 as shown in FIG. 13(*a*). In this case the lower end of the hanging bolts 44 utilizes the slit 39 formed in the upper surface of the box 38 of the bar 35. That is, as shown in FIG. 13(*b*), to prevent the bolt 44 from dropping out of the slit 39, a nut 45 having the diameter larger than the width of the slit 39 is fitted onto the lower end of the bolt 44 and slidably moved to a predetermined position from the end of the bar 35 in the slit 39 while being fitted onto the bolt 44.

Figure 17A:
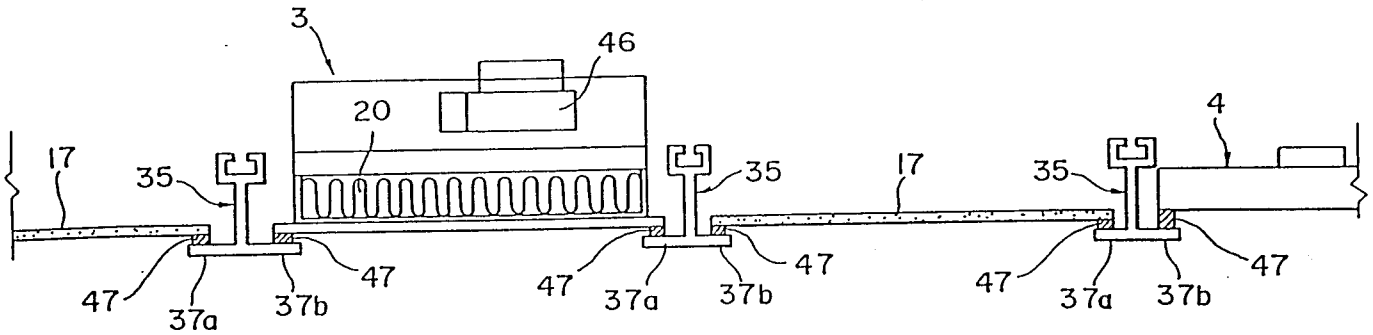
FIG. 17(*a*) is a schematic sectional view showing the condition of ceiling elements attached to the ceiling bars constituted from the bars in FIG. 11.
Figure 17B:
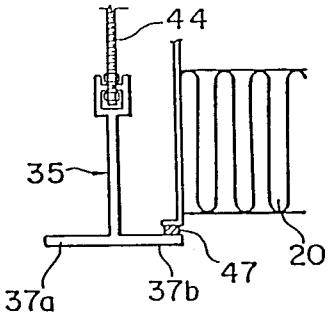
Figure 18:
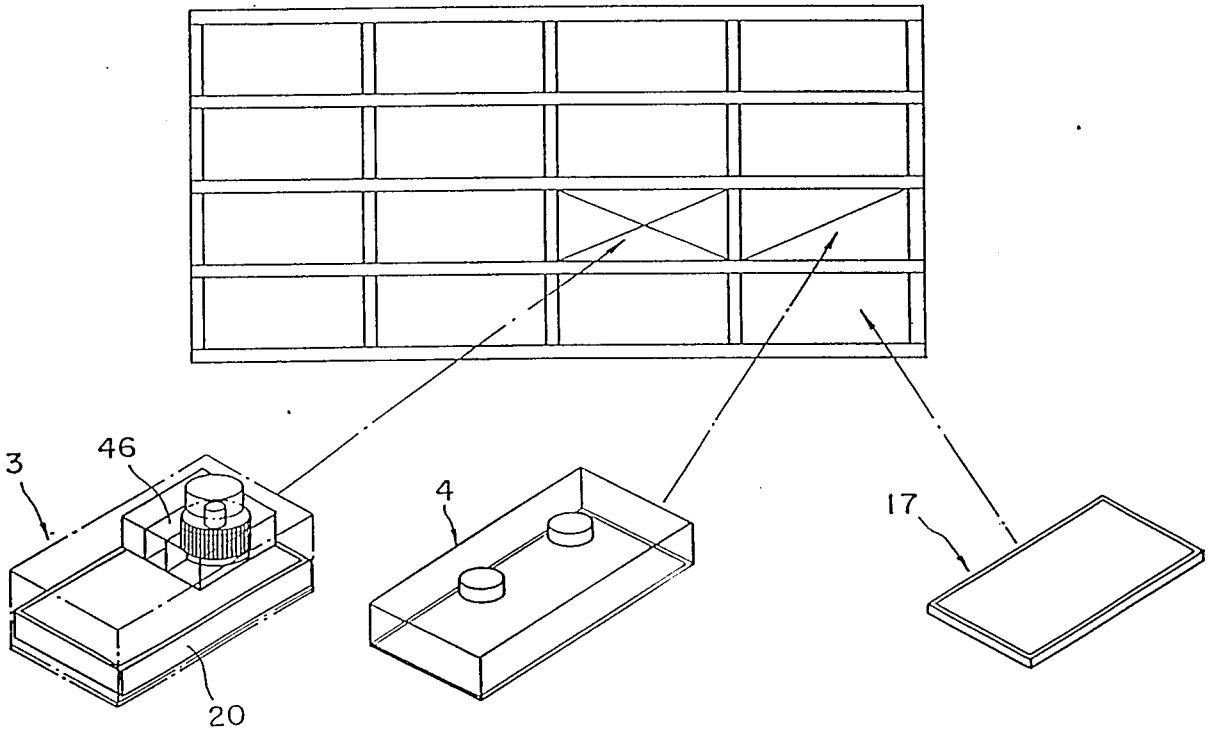
FIG. 18 is a view for illustrating an example of the mounting relation of the ceiling elements to openings of the ceiling bars.

FIG. 17(*a*) shows the ceiling elements attached to the ceiling bar formed by the assembly of the T-bars. As shown in the drawing, on the flanges 37*a* and 37*b* of the bars 35 are mounted the outer edges having the same rated dimension of the blind panels 17, fan filter unit having a built-in fan 46 and HEPA filter 20 and air inlet port unit 4 through gaskets 47. The gasket 47, for example, is a rod-like body made of neoprene rubber, and beforehand bonded to the lower surface of the outer peripheral edge of each ceiling element to form a continuous quadrilateral. Thus, when each ceiling element is mounted on the flanges 37*a* and 37*b*, the rubber is compressed by the weight of the member to complete the attachment under the satisfactory sealed condition. Since this attachment is removable, the position of the ceiling elements can be freely changed. FIG. 17(*b*) shows more particularly the fan filter unit 3 attached to the bar 35. FIG. 18 shows a selected example of the ceiling elements attached to the openings of the ceiling bar formed as shown in FIG. 12.

Figure 19:
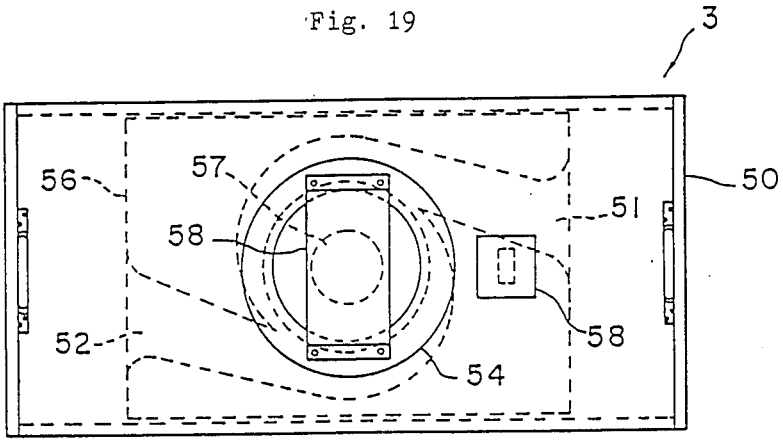
FIGS. 19 and 20 are respectively a plan view and a side view showing an example of a fan filter unit.
Figure 20:
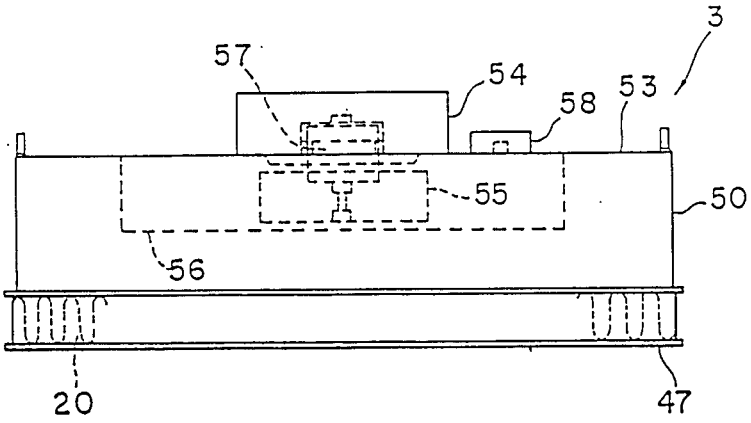
Figure 22:
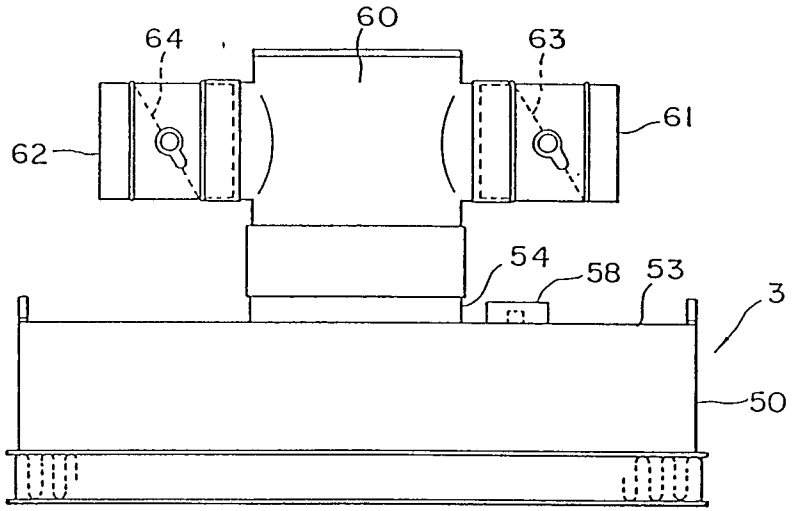
FIG. 22 is a side view showing the condition of a connecting box connected to the fan filter unit.
Figure 21:
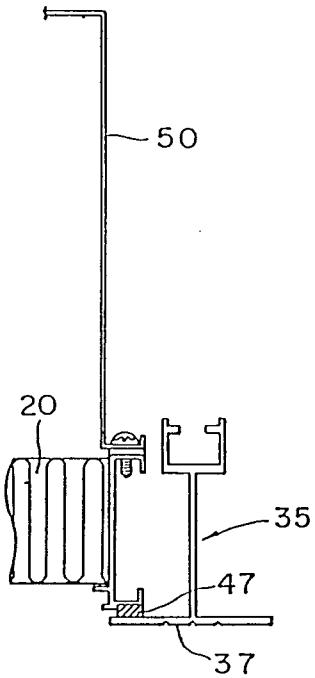
FIG. 21 is a schematic sectional view showing the mounting relation of the fan filter unit to the bar.

FIGS. 19 and 20 are a plan view and a side view, respectively, showing the embodiment of the fan filter unit which can be preferably used in the practice of the invention. In the fan filter unit, the HEPA filter 20 is housed horizontally in a rectangular parallelopiped casing 50 opened in the lower surface to close the opening in the lower surface, and a fan having two discharge ports 51 and 52 is housed in the upper casing space of the HEPA filter 20. A cylindrical opening tube 54 is mounted on the central portion of the upper surface 53 of the casing 50. A fan case 56 and a motor 57 are installed such that the center of a fan runner 55 coincides with the center of the tube 54. Reference numeral 58 designates a plate for supporting the motor 57 and the fan case 56, and is secured to the upper surface 53 such that it may cross the inside of the tube 54. Reference numeral 58 designates a power supply terminal bed and numeral 47 a gasket mounted on the peripheral edge of the opening in the lower surface. When the motor 57 is driven to rotate the fan runner 55, the air is sucked from the tube 54 side and discharged laterally from the discharge ports 51 and 52 at both sides into the casing space. The air discharged into the casing changes its direction at the casing side wall and flows downward to be blown out downward from the opening in the lower surface of the unit through the HEPA filter 20. FIG. 21 shows the relationship between the fan filter unit and the T-bar 35 connected thereto. Also, FIG. 22 shows an example of a connecting box 60 for connecting two ducts to the fan filter unit. As previously described, since the air from the air inlet port units and the air conditioner is supplied to the fan filter units by the connection of the ducts, the connecting box 60 having connecting ports 61 and 62 leading to each duct is mounted on said tube 54. Dampers 63 and 64 for adjusting the air amount taken in from the connecting ports 61 and 62 are mounted on the connecting box.

Figure 23:
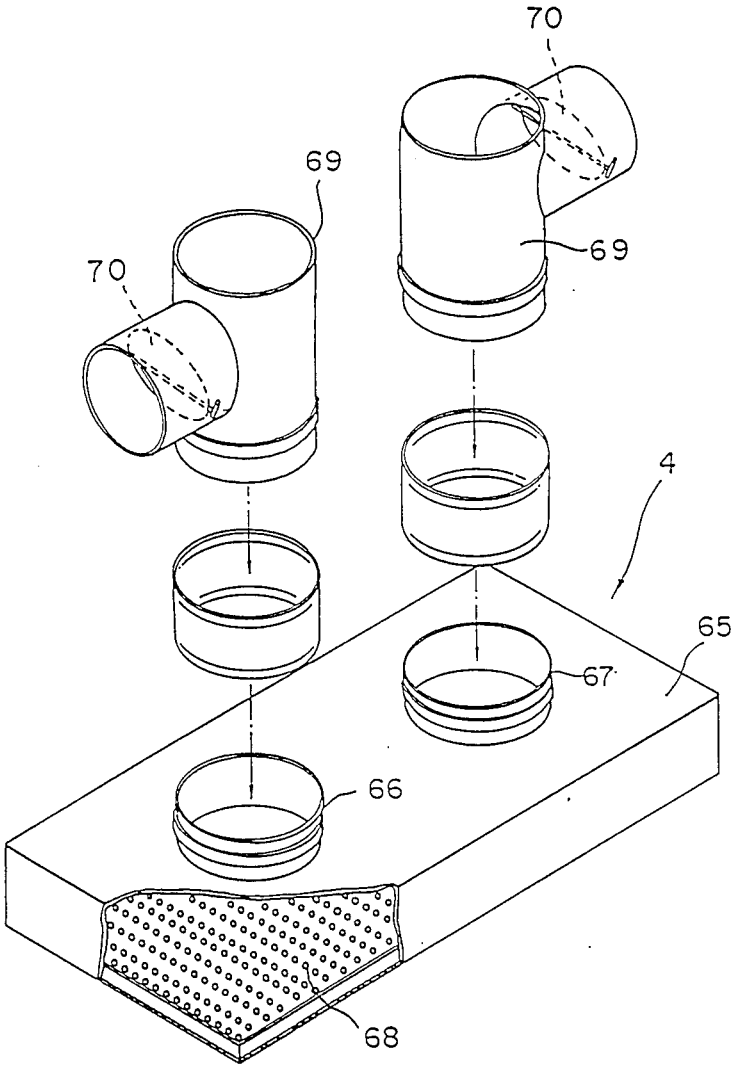
FIG. 23 is a partially cut-away perspective view showing an example of a return air inlet port unit.

FIG. 23 is a cut-away perspective view showing an example of the air inlet port unit which can be preferably used according to the present invention. The air inlet port unit comprises a rectangular parallelopiped casing opened in the lower surface. Two short tubes 66 and 67 are mounted on the upper surface 65 of the casing and a punching board 68 is stretched across the opening in the lower surface. To each of tubes 66 and 67 are connected through the connecting boxes 69 the connecting duct connected to the fan filter unit and the duct connected to the air conditioner. Dampers 70 are mounted on the connecting boxes 69. The dampers 70 and the dampers 63 and 64 of the connecting boxes of the fan filter units are all adjusted manually with respect to the opening. According to the present invention, the manual adjustment of the dampers can be simply carried out from the inside of the clean room by removing the blind panel mounted removably on the opening near the dampers. Also, when the rectangular opening is formed by the T-bar system, even the fan filter unit, air inlet port unit and blind panel each having area somewhat larger than that of the opening can be lifted on the upper side of the opening from the lower side thereof by slanting the short side of these units to the long side of the opening.

Figure 24:
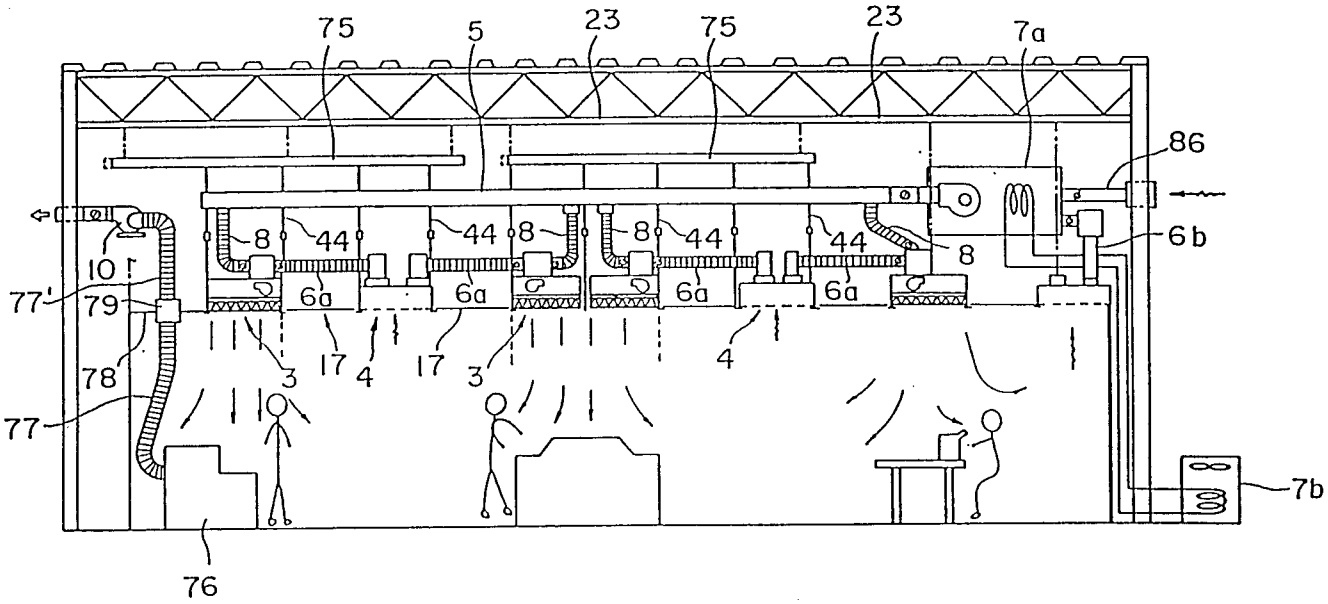
FIG. 24 is a schematic longitudinal sectional view showing a modification of the embodiment shown in FIG. 10, and particularly showing an example of a ceiling hanging structure of the ceiling structure.
Figure 25:
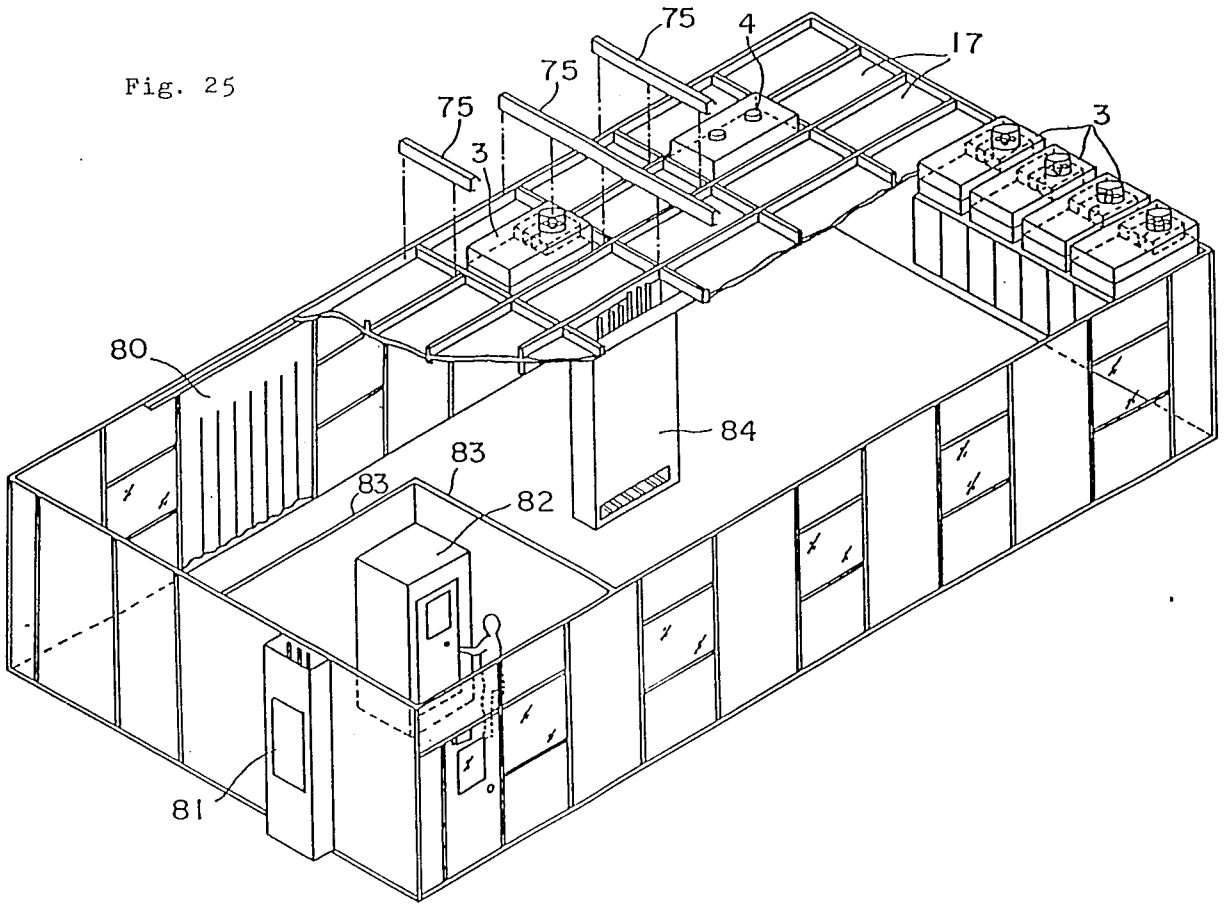
FIG. 25 is a partially cut-away perspective view showing an example of the clean room system according to the invention provided with various facilities.

FIGS. 24 and 25 shows an example of a ceiling hanging structure constituting a ceiling structure with the T-bar system according to the present invention. When the ceiling structure is formed by constituting the ceiling bar according to the present invention and attaching the ceiling elements to the openings, the ceiling structure must be horizontally held and the whole load thereof must be supported reasonably. Thus, preferably hanging bars 75 shown in FIGS. 24 and 25 are used. FIG. 24 is a side view showing the hanging bars 75 suspended approximately horizontally from the existing beams 23 in the factory and the T-bar suspended from the hanging bars 75 by means of the hanging metallic members 44. As shown in FIG. 25, the hanging bars 75 which are parallel to each other can disperse the load by suspending the necessary numbers thereof from the beams. The hanging metallic members 44 can adjust freely the horizontality of the T-bar system by interposing a hanging length adjusting devices.

Further, in the embodiment of the present invention shown in FIG. 24 the main supply air duct 5, branched main supply air duct 8, return air duct 6*a* (connecting duct for introducing the air from the air inlet port units 4 to the fan filter units 3 without passing the air through the air conditioner 7*a*) and circulating return air duct 6*b* are interconnected in relation to each other similarly to these in FIG. 10. However, in this embodiment an exhaust duct 77 is provided for a zone having a particle shedding productive machine 76 in the room and communicates to the ceiling through a panel 78 attached to the opening of the ceiling bar so that the exhaust is exhausted to the outdoors through a duct 77' by the exhaust fan 10. The panel 78 has the rated dimension adapted to close the opening and a through pipe 79 attached to the blind panel. The exhaust duct is connected to both ends of the through pipe 79 of the panel. The air amount exhausted to the outside of the system by the exhaust fan 10 is taken from the outside of the system into the indoor half 7*a* by an open air duct 86. In FIG. 24, the outdoor half 7*b* is installed on the ground outside the building. Also, in the embodiment shown in FIG. 25 are used various facilities, such as a vinyl curtain 80, a distributing board 81, an air shower box 82, walls 83 for an anteroom in which the air-shower box 82 is provided. Reference numeral 84 designates a core member for uplifting electric wires or the like among these members to bring it to the ceiling.

Some preferable embodiments of the clean room system according to the present invention have been described. As shown in these embodiments, the configuration of the air flow in the clean room according to the invention has not been employed by the prior high degree clean room which blows out and takes in air on the ceiling surface. Also, since the exhaust plenum for planer suction on the floor surface or the like and the supply air plenum for planer blow-out on the ceiling surface are not used, the skilled in the art may necessarily doubt whether or not the rearly necessary clean zones can be formed in the necessary area. The result of measurement performed and described hereinafter by this inventor will answer satisfactorily such a question.

Figure 26:
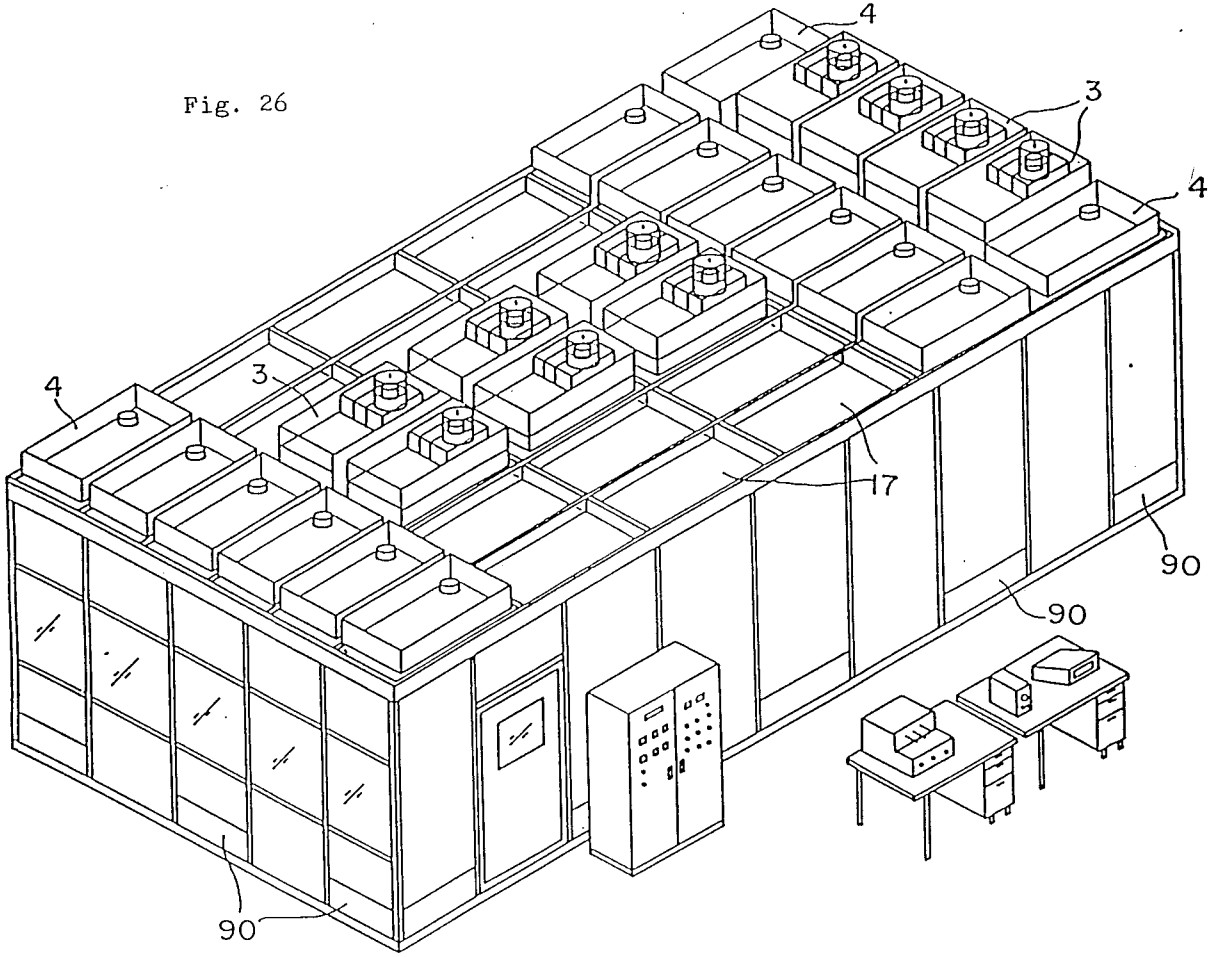
FIG. 26 is a perspective view showing the external appearance of the clean room system according to the invention used for various measurements described in this specification.
Figure 27:
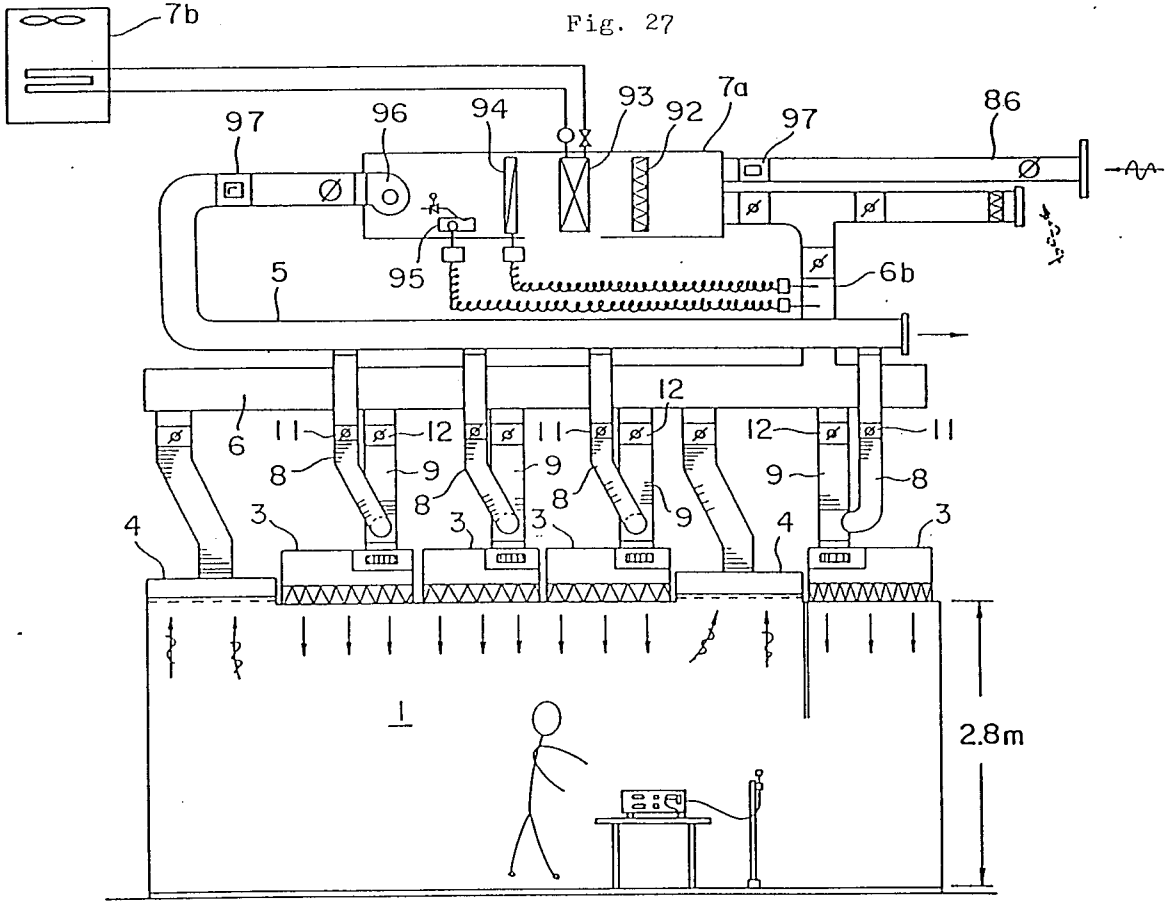
FIG. 27 is a view of an instrument arrangement system showing the connecting relationship between various instruments and members of the air treating equipment of the clean room in FIG. 26.

FIG. 26 is a pictorial drawing showing the clean room according to the invention served for the measurement. The external size of the whole clean room is 2800 mm of height × 3980 mm of widness × 7640 mm of length. As previously described, the clean room has the fan filter units 3 and the air inlet port units 4, and the working numbers and locations of which can be freely changed. Also, plates 90 are removably provided in equal intervals at the lower portion of the walls (portion of base-board contacting the floor surface) and the air inlet port units may be attached to the openings from which the plates 90 have been removed, so that the experiment of sucking downward can be performed for comparison. FIG. 27 shows a system of air treating equipment of facilities in FIG. 26. In the reference numerals in the drawing, the same numerals as that used in FIGS. 1 to 25 designate the members each having the same meaning as that in FIGS. 1 to 25. The indoor half 7*a* is provided with an electric heater 94 capable of controlling the calorific power and a humidifier 95 capable of controlling the humidifying amount in addition to a filter 92 and a heat exchanger 93 (evaporator for forming the refrigerating cycle between itself and the outdoor half 7*b*). Also, a fan 96 of the indoor half 7*a* has a capacity of sending the air to the fan filter units 3. Reference numeral 97 designates an air flow detector.

Measurement No. 1 of air flow pattern (effect of positions of air inlet ports on air flow pattern)

Figure 28:
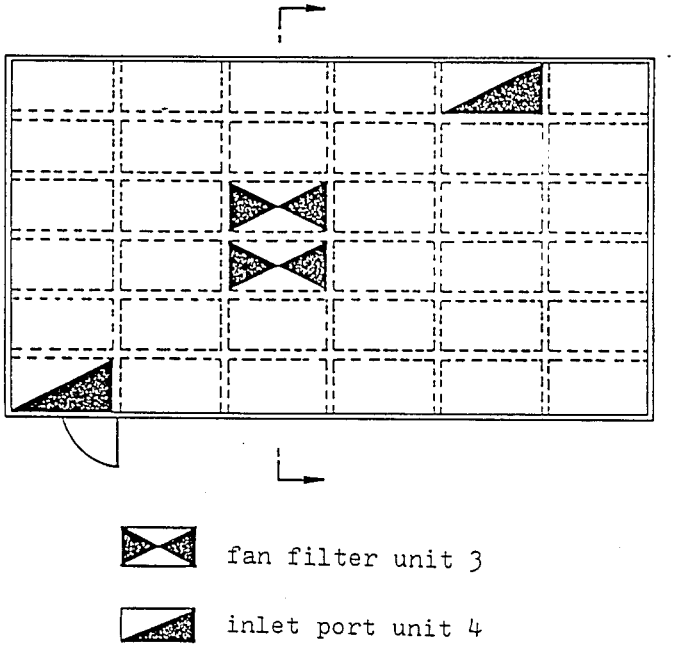
FIG. 28 is a plan view showing an arrangement of the ceiling elements in the No. 1 of measurement of air flow pattern in this specification.
Figure 29:
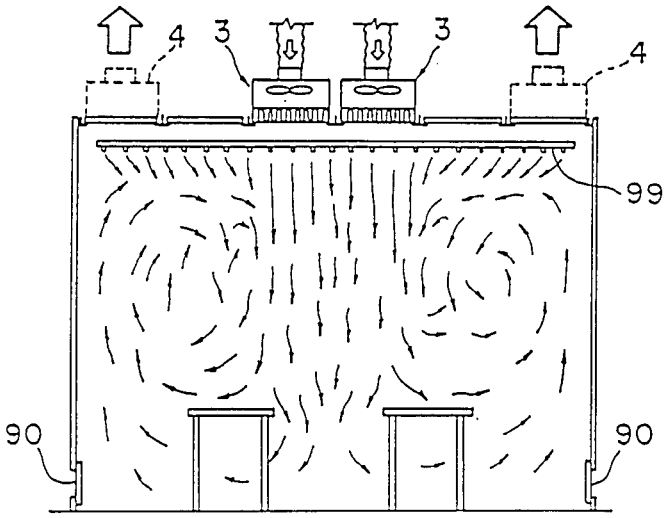
FIGS. 29 and 30 are views showing the air flow patterns obtained from the measurement.

FIG. 29 shows the air flow pattern under the steady state in which the fan filter units 3 and the air inlet port units 4 illustrated in FIG. 28 are arranged on the ceiling bar and operated with 0.35 m/s of blown out wind velocity from each fan filter unit 3, 0.30 m/s of ceiling inlet wind velocity to each air inlet port unit 4 and 20 times/hour of ventilation. FIG. 29 shows the air flow pattern in the section of the equipment as viewed in the direction of arrow in FIG. 28. The air flow pattern was photographically observed through smoke from smoke generating nozzles 99 disposed right below the ceiling structure.

Figure 30:
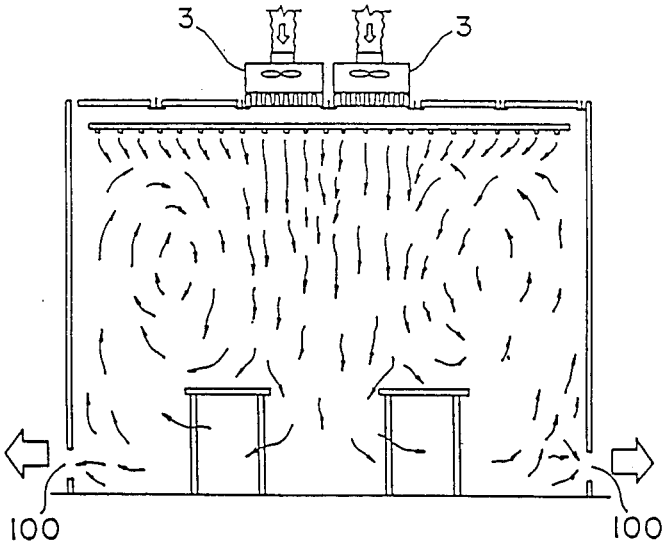

For comparison, the plates 90 of the baseboard (see FIG. 26) were removed and the opening 100 of the baseboard was connected to the main return duct 6 through a duct. And the equipment was operated under the same condition as said one except for the air inlet port units 4 closed on the ceiling surface. FIG. 30 shows the air flow pattern in this case.

The air flow patterns in FIGS. 29 and 30 presemble each other astonishingly. That is, the air flow pattern is not so much affected by the positions of the air inlet ports. This may be caused by a phenomenon that the flow speed of inlet air flow produced near the air inlet port is reduced abruptly when the inlet air flow is kept away from the air inlet port. On the other hand, even when the blown-out air flow is kept away from the blown-out port, the degree of the speed reduction is remarkably slower than that of the inlet air flow and the reach of the blown-out air flow is long. Thus, an air flow pattern substantially same as the prior floor and wall suction systems can be obtained even by the ceiling surface outlet and inlet system clean room according to the invention.

Measurement No. 2 of air flow pattern (short circuit)

Figure 31:
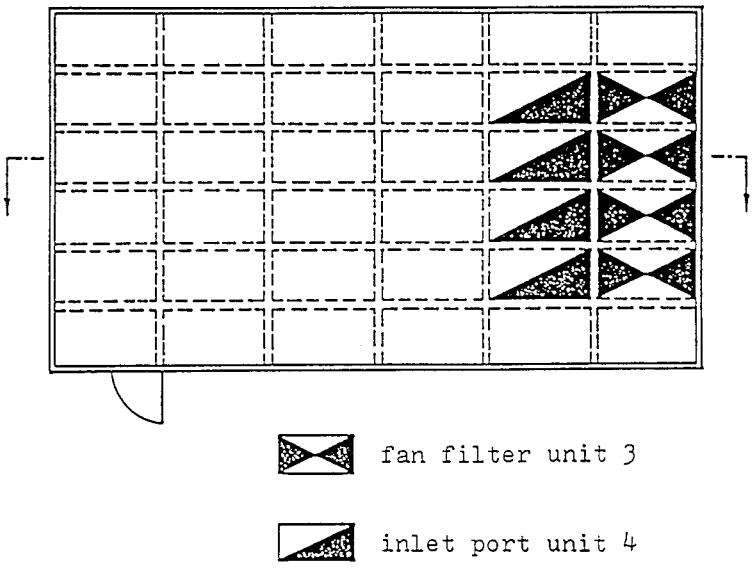
FIG. 31 is a plan view showing an arrangement of the ceiling elements in the No. 2 of measurement of the air flow pattern in this specification.
Figure 32:
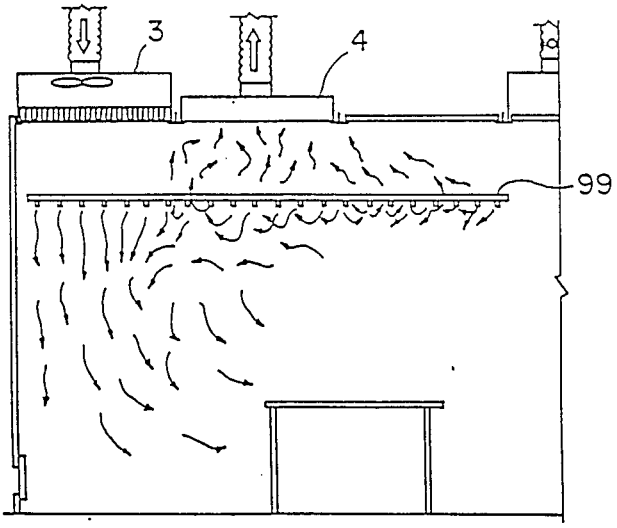
FIG. 32 is a view showing the air flow pattern obtained from the measurement.

FIG. 32 shows the result of measurement in which the fan filter units 3 and the air inlet port units 4 are arranged as shown in FIG. 31 and the air flow pattern under the steady state is measured by the method similar to said one when the equipment is operated with 0.35 m/s of blown-out wind velocity, 0.30 m/s of inlet wind velocity and 40 times/hour of ventilation. This result shows that even if the air inlet port units 4 are arranged adjacent to the fan filter units 3 where the short-circuit is most likely to produce as shown in FIG. 31, the short circuit is not produced. That is, into the air inlet port units 4 on the ceiling is sucked only the air right below said units 4, and the air blown out of the fan filter units 3 is blown out into the room with the long reach irrespective of the presence of adjacent air inlet port units 4 and not affected by the inlet air flow.

Measurement of degree of recovered cleanliness

Figure 33:
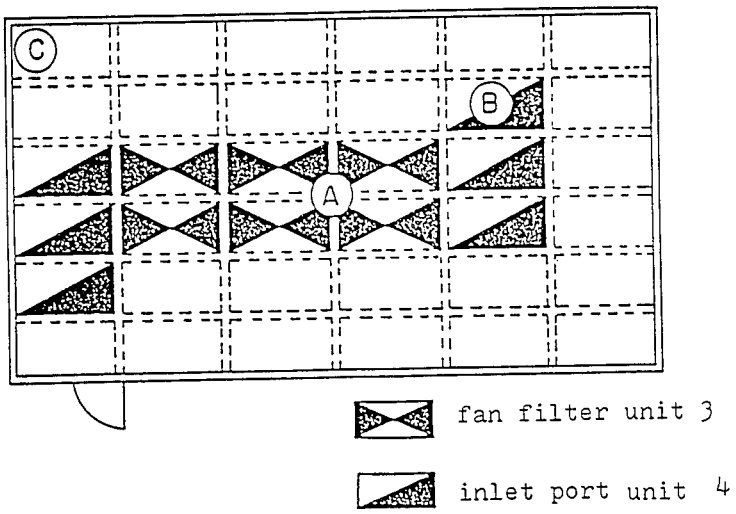
FIG. 33 is a plan view showing an arrangement of the ceiling elements in the recovery measurement of the degree of cleanliness in this specification.
Figure 34:
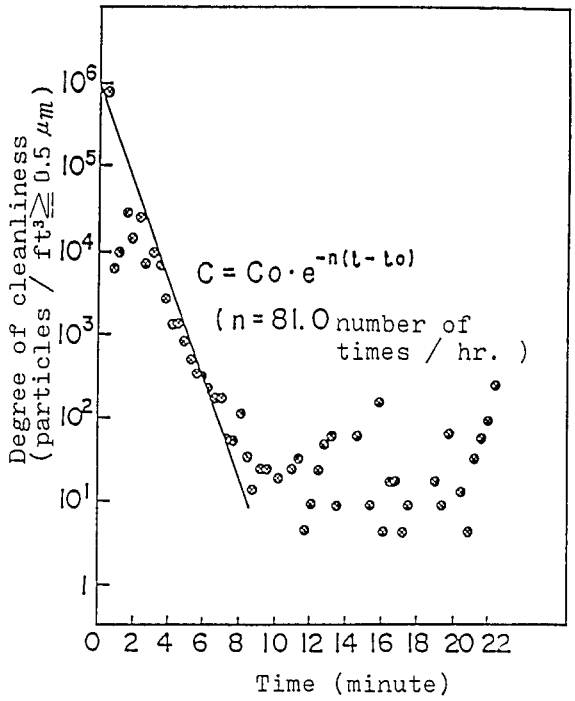
FIGS. 34, 35 and 36 are views of changes with time in the degree of cleanliness, showing the results of the measurement.
Figure 35:
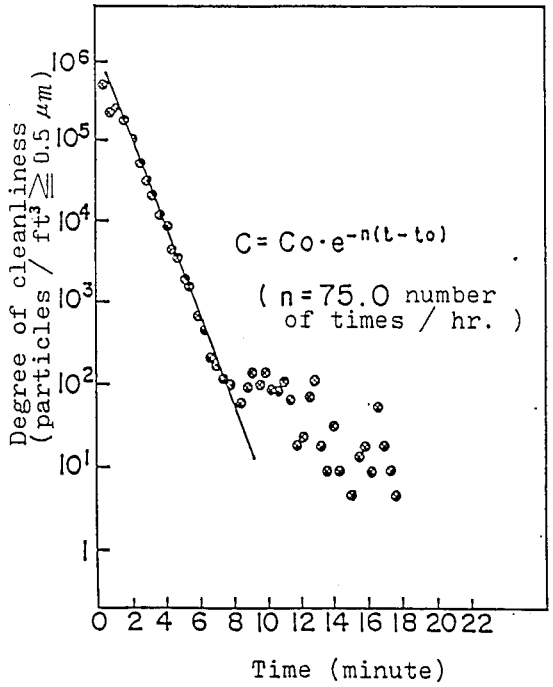
Figure 36:
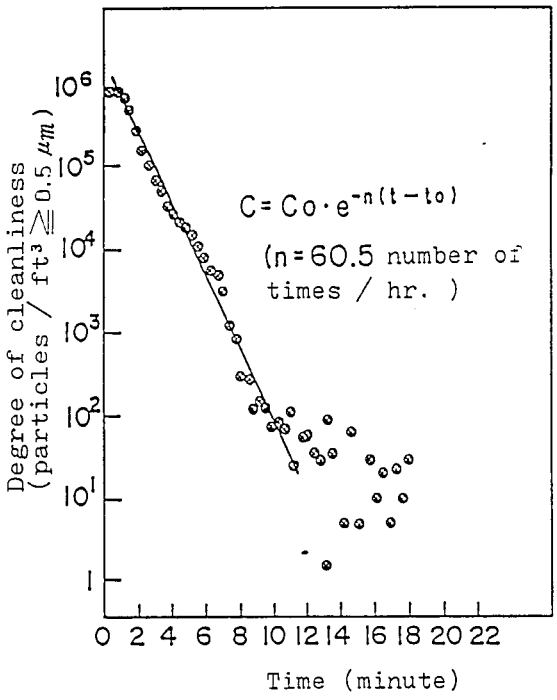

The fan filter units 3 and the air inlet port units 4 are arranged as shown in FIG. 33 and the equipment is operated with 61.1 times/hour of design ventilation. The interior of the room is once contaminated with smoke of tobacco before the operation to about a degree of cleanliness of Class 1,000,000. And how the degree of cleanliness is recovered after the beginning of operation is measured in the planer positions A, B and C, these portions being located as shown in FIG. 33 and 1 m above the floor. The degree of cleanliness in each position is measured by a commercially available particle counter (No. 247 made by Lloicho Co., Ltd.) and a change with time in the degree of cleanliness at each position is continuously recorded. FIG. 34 shows the result of measurement in the point A, FIG. 35 the result of measurement in the point B and FIG. 36 that in the point C. The formula $C=Co\cdot e^{-n(t-to)}$ in FIGS. 34 to 36 gives the number of times of ventilation n. In the formula, C is dust concentration (particles/$ft^3$) in the begining of measurement, Co the dust concentration (particles/$ft^3$) at time t, t the passage time after the beginning of operation and $t_0$ the time taken from the beginning of operation to the beginning of reduction of the dust concentration. The degree of cleanliness shown by the ordinate in FIGS. 34 to 36 is represented by logarithmic scale and its value corresponds to that of the U.S. Federal Standard 209b.

The following is found from the results of FIGS. 34 to 36. The recovery of degree of cleanliness in the point C where the air flow stagnates the most likely reaches the stable state in about 12 minutes and the number of times of ventilation in this point is 60.5 times/hour which is not so much different from the design one. That is, even in position where the air flow is considered to stagnate in the clean room according to the invention is maintained the high number of times of ventilation so that dust does not keep floating in that place. The recovery reaches the steady state at points A and B in about 9 minutes, and the stagnation of the air flow which blocks the purification of air is not found. That is, even in the ceiling inlet clean room according to the present invention does not actually take place the phenomenon that the number of times of ventilation is reduced by the short-circuit and the stagnation zones are increased.

Comparative measurement of degree of cleanliness

Figure 37:
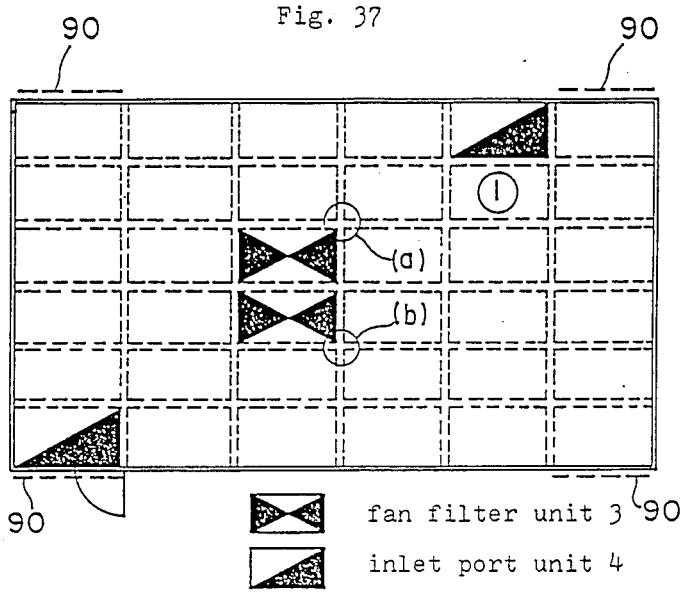
FIG. 37 is a plan view showing an arrangement of the ceiling elements in the comparative measurement of the degree of cleanliness in this specification.

The fan filter units 3 and the air inlet port units 4 are arranged as shown in FIG. 37 and the clean room is operated under the same condition as that of the previously described measurement No. 1 of air flow pattern. Two workers wearing working uniforms stand stationarily at positions (a) and (b) on the floor in FIG. 37, and said particle counter is set in the planer position which is shown by ① in FIG. 37 and is 1 m above the floor so that the stationary workers operate the clean room until the degree of cleanliness measured by the particle counter reaches about Class 100. When the degree of cleanliness reaches the Class 100, both workers begin to step for emitting dust from the bodies and the working uniforms. The degree of cleanliness is kept measuring at the position ①. Also, for comparison , the degree of cleanliness at ① is measured by the same method as said one except for that all air inlet port units 4 of the ceiling are closed and the main return ducts 6 are connected through duct to the four openings from which the plates 90 in the base-boards are removed at four positions as shown in FIG. 37. The results of these measurements are shown in FIG. 38.

Figure 39:
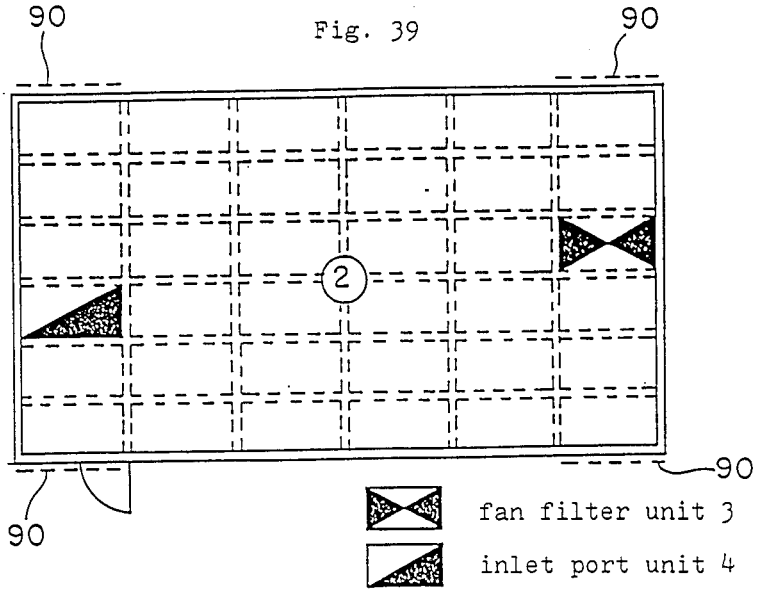
FIG. 39 is a plan view showing another arrangement of the ceiling elements in the mesurement.

The measurement is carried out similarly to said one except for that the arrangement of the fan filter unit 3 and the air inlet port unit 4 is changed as shown in FIG. 39 and the degree of cleanliness is measured in the position shown by ② in FIG. 39. The result of the measurement is shown in FIG. 40.

Figure 41:
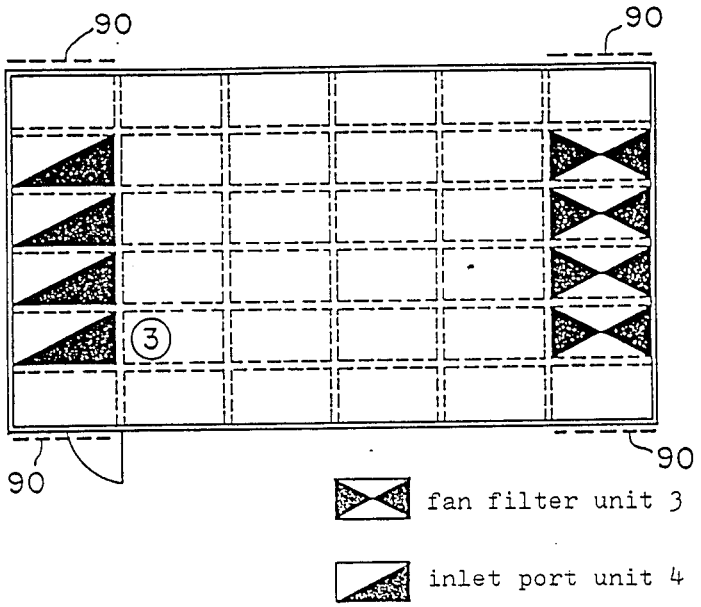
FIGS. 41 and 42 are plan views showing other arrangements of the ceiling elements in the measurement.
Figure 42:
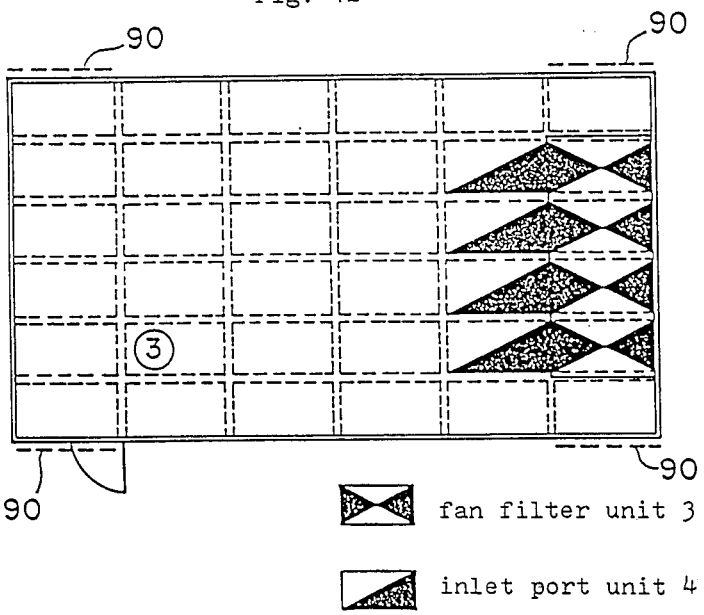

Further, the measurement is carried out similarly to said one except for that the arrangement of the fan filter units 3 and the air inlet port units 4 is changed as shown in FIGS. 41 and 42 and the degree of cleanliness is measured in the position shown by ③ in these drawings. The result of the measurement is shown in FIG. 43.

Figure 38:
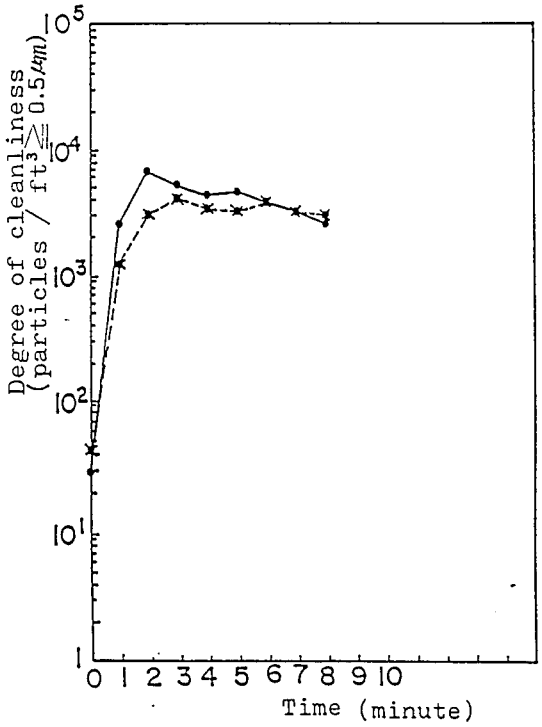
FIG. 38 is a view showing a change with time in the degree of cleanliness in the arrangement in FIG. 37.
Figure 40:
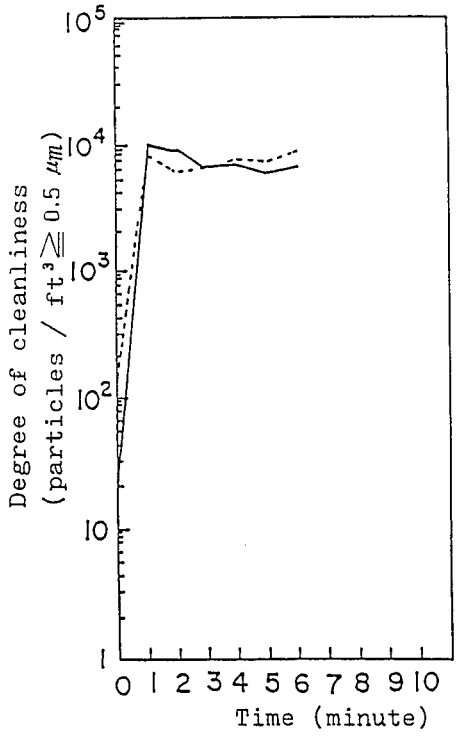
FIG. 40 is a view showing a change with time in the degree of cleanliness in the arrangement in FIG. 39.
Figure 43:
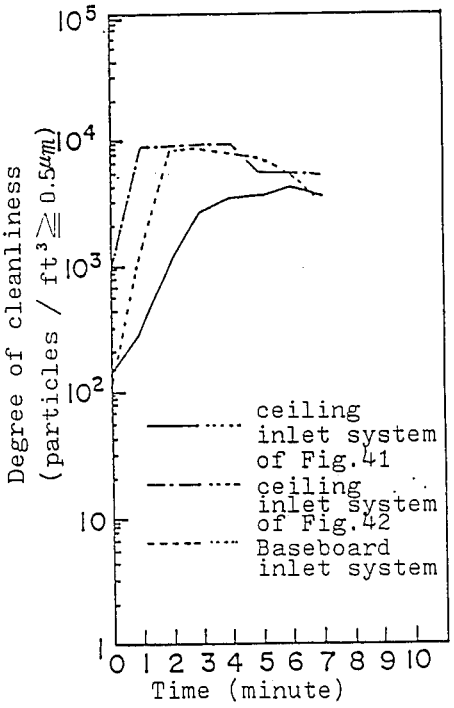
FIG. 43 is a view showing a change with time in the degree of cleanliness in the arrangement in FIGS. 41 and 42.

The results of measurements in FIGS. 38, 40 and 43 show that while the ceiling inlet system differs somewhat from the baseboard inlet system immediately after the beginning of generation of dust, the degrees of cleanliness in the respective measuring positions reach the steady states having approximately same levels in both systems after at least 8 minutes. That is, the degree of cleanliness which is same as that in the baseboard inlet system is attained even by the ceiling inlet system according to the invention although some time-lag takes place.

Fine particle take-up test

Figure 44:
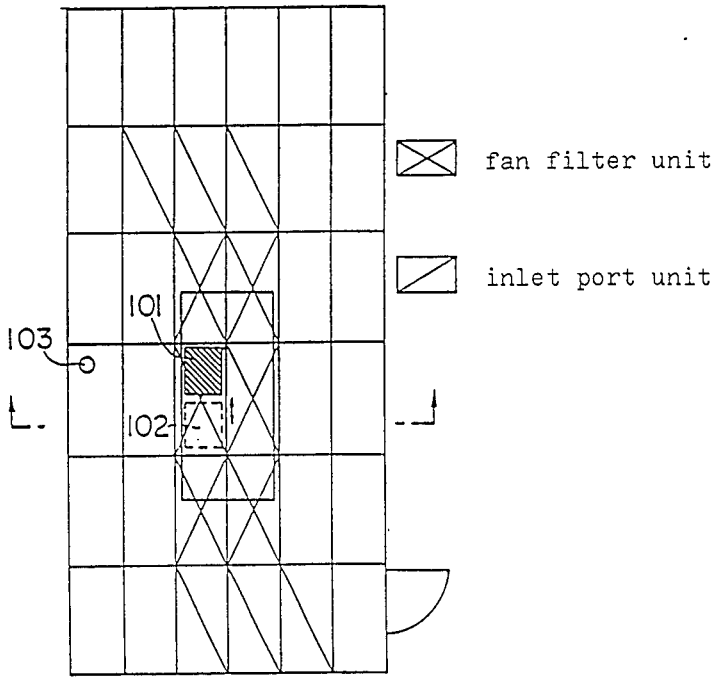
FIG. 44 is a plan view showing an arrangement of the ceiling elements and the test tools in a fine particle take-up test in this specification.
Figure 45:
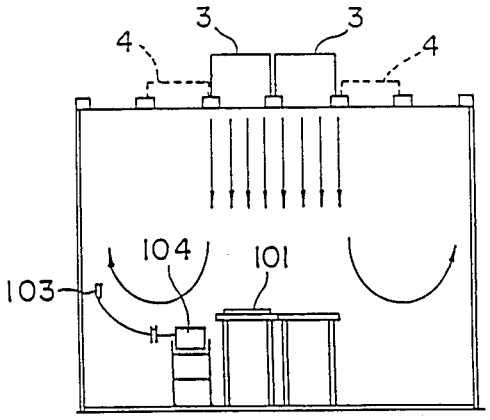
FIG. 45 is a sectional view of the arrangement of tools as viewed in the direction of arrow in the same test in FIG. 44.

The fan filter units 3 and the air inlet port units 4 are arranged as shown in FIG. 44 and a plate 101 is placed on a desk as shown in FIG. 45 (section as viewed in the direction of arrow in FIG. 44). A slide cover 102 (see FIG. 44) is mounted on the plate 101, and adapted to be removed from the plate 101 from the outside of the room in the unattended manner. A probe 103 is set in the position shown in the drawing and the degree of cleanliness in this position is measured by the particle counter 104.

Figure 46:
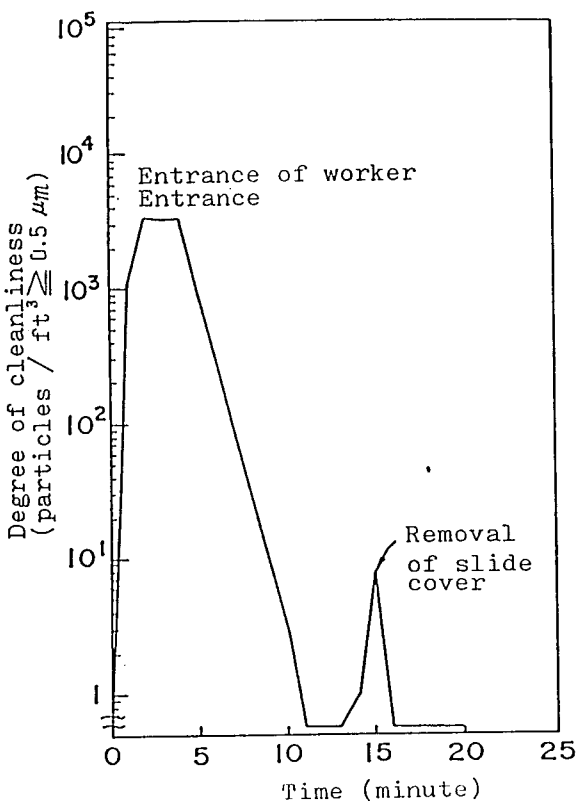
FIG. 46 is a view of a change with time in the degree of cleanliness showing a result of a control example of the same test.

Control test: The clean room is operated under the same condition of air flow as that described with reference to FIG. 33 and a worker enters the clean room with an empty plate 101. The worker exits the clean room after about 5 minutes leaving the plate 101 empty, i.e. without putting dusting materials for test in the plate 101. After the clean room is operated until the degree of cleanliness approaches zero count, the slide cover 102 is operated from the outdoors to be removed from the plate 101. The result of measuring the degree of cleanliness in the test is shown in FIG. 46. The time point of 15 minutes in FIG. 46 is one at which the slide cover 102 is removed by the operation from the outdoors.

Figure 47:
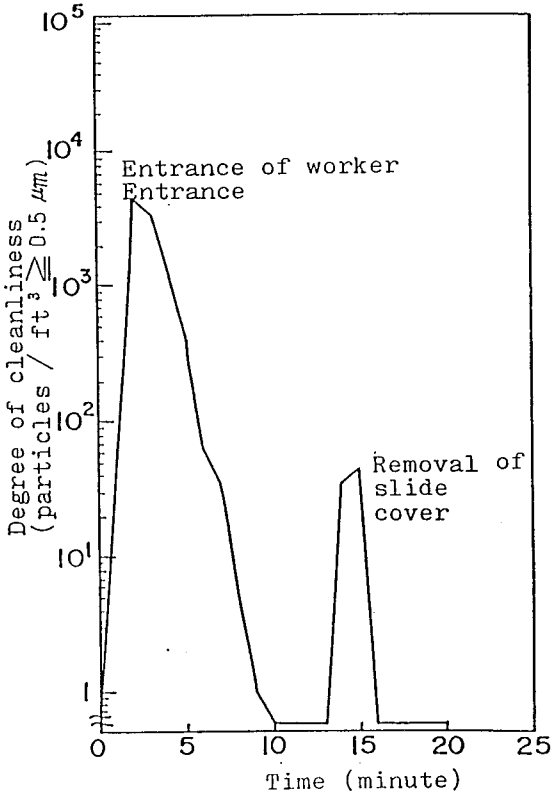
FIG. 47 is a view of a change with time in the degree of cleanliness showing a result of the same test.

Dusting test: The degree of cleanliness is measured similarly to said control test except for that the worker enters the room bringing fine particles of average 8 microns of Kanto loam put in the plate 101 and leaves the room with the plate 101 being covered with the slide cover 102. The result of measuring the degree of cleanlines in this test is shown in FIG. 47. The time point of 15 minutes in FIG. 47 is one at which the slide cover 102 is removed by the operation from the outdoors.

The following is found from the results of FIGS. 46 and 47. While the value of the result of measurement in FIG. 47 minus that in FIG. 46 will represent the contamination due to the taking-up of dusting materials for test, the contamination is reached to about a degree of cleanliness of Class 3000 in the time point of 15 minutes in FIG. 47 at which the slide cover is removed (in FIG. 46, the contamination is reached to about a degree of cleanliness of Class 1,000 in the same time point), and returned to zero count after 1 minute. That is, even if light and fine particles for test are exposed to the air flow the phenomenon that the fine particles are taken up by the air flow does not take place.

The above mentioned results of measurements are sufficient to dispel reasonable doubts of the skilled in the art whether or not the exhaling air makes short-circuit when the inlet port is on the ceiling and dust on the work table and floor is taken up in addition to questions of the skilled in the art whether or not the rising air flow takes place to disturb the indoor air flow, the stagnation zone of the air flow takes place in the room, more blast amount is required to provide the same degree of cleanliness, the dusting is liable to be expanded to the whole room, partial laminer flow is difficult to provide and the taking up to the laminer flow area is enlarged. It is considered that such results are obtained from the presence of basic phenomenon that the air flow sucked into the air inlet port units on the ceiling has rather higher speed just near the air inlet port units, and already does not have such speed as affects the indoor air flow pattern even when the air flow is slightly kept away from the air inlet port units 4. In the normal operating condition, the inlet air flow observed in such a position as spaced about 10–20 cm from the air inlet port units for example does not take place already. On the other hand, the blown-out air flow from the fan filter units reaches the floor and gives a large effect to the air flow pattern in the clean room. Thus, according to the invention, the desired clean zones can be at will formed by selecting properly the locations and numbers of the fan filter units 3.

What is claimed is:

1. A clean room system for constructing a clean room having clean zones of different degrees of cleanliness ranging from Class 100 to Class 100,000 according to the U.S. Federal Standard 209b, by forming a ceiling in an exsiting building to form an enclosed space insulated from the ambient atmosphere by said ceiling and suitable floor and walls and installing an air treating equipment for supplying clean air into said enclosed space and withdrawing an air amount therefrom substantially corresponding to the amount of the clean air supplied thereinto, characterized in that:

said ceiling is formed by horizontally suspending ceiling bars provided with a plurality of rectangular openings having substantially same predetermined configuration and dimension and supporting removably to the openings of the ceiling bars prefabricated ceiling elements each having a base area adapted to close each of said openings so as to close each opening by each ceiling element, said ceiling element being selected from the group consiting of a blind panel, a return air inlet port unit and a fan filter unit having a built-in fan and HEPA filter;

an air conditioner is installed outside the enclosed space, supply air duct means for introducing air conditioned by the air conditioner into each fan filter unit and return air duct means with a connecting duct which can introduce air taken in at least one of the air inlet port units into each fan filter unit without passing the air through the air conditioner are installed outside the enclosed space; and the positions and numbers of said ceiling elements removably supported to the openings are selected according to the positions and the degrees of cleanliness of the desired clean zones to form clean zones having different degrees of cleanliness in the enclosed space by ceiling surface exhaling and inhaling air flows.

2. A clean room system in accordance with claim 1, wherein the walls and floor for forming the enclosed space are constituted from the walls and floor surfaces having no air inlet port for forcibly sucking the air from the enclosed space.

3. A clean room system in accordance with claim 1, wherein the building is a factory.

4. A clean room system in accordance with claim 1, wherein said ceiling is formed as working machines are left thereunder.

5. A clean room system in accordance with claim 2, wherein the building is a factory.

6. A clean room system in accordance with claim 2, wherein said ceiling is formed as working machines are left thereunder.

7. A clean room system in accordance with claim 3, wherein said ceiling is formed as working machines are left thereunder.

8. A clean room system in accordance with claim 5, wherein said ceiling is formed as working machine are left thereunder.

* * * * *